US011591737B2

(12) United States Patent
Kim et al.

(10) Patent No.: US 11,591,737 B2
(45) Date of Patent: Feb. 28, 2023

(54) WASHING MACHINE AND METHOD OF CONTROLLING THE SAME

(71) Applicant: Samsung Electronics Co., Ltd., Suwon-si (KR)

(72) Inventors: Kyoung Sup Kim, Suwon-si (KR); Eun-Young Park, Suwon-si (KR); Hyun Sook Kim, Hwaseong-si (KR); Dong-Il Back, Hwaseong-si (KR); Jun-Young Choi, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 17/105,342

(22) Filed: Nov. 25, 2020

(65) Prior Publication Data

US 2021/0079578 A1 Mar. 18, 2021

Related U.S. Application Data

(62) Division of application No. 15/856,869, filed on Dec. 28, 2017, now Pat. No. 10,858,775.

(51) Int. Cl.
*D06F 29/00* (2006.01)
*D06F 31/00* (2006.01)
(Continued)

(52) U.S. Cl.
CPC ..... *D06F 33/72* (2020.02); *D06F 31/005* (2013.01); *D06F 33/00* (2013.01); *D06F 33/32* (2020.02);
(Continued)

(58) Field of Classification Search
None
See application file for complete search history.

(56) References Cited

U.S. PATENT DOCUMENTS 7,904,983 B2 3/2011 Jun et al.
2009/0133197 A1 5/2009 Lee et al.
(Continued)

FOREIGN PATENT DOCUMENTS

CN 101113557 A 1/2008
CN 101994226 A 3/2011
(Continued)

OTHER PUBLICATIONS

International Search Report for PCT Patent Application No. PCT/KR2017/015430 dated Apr. 30, 2018; 5 pages.
(Continued)

*Primary Examiner* — Levon J Shahinian

(57) ABSTRACT

A washing machine in which a first main heater is not driven while wash water stored in a first tub and wash water stored in a second tub are simultaneously heated, and a method of controlling the same. A washing machine includes: a first tub configured to store wash water; a first main heater configured to heat wash water stored in the first tub; a first sub heater configured to heat wash water stored in the first tub; a second tub configured to store wash water; and a second heater configured to heat wash water stored in the second tub, wherein a power consumption required to drive the first main heater is greater than a power consumption required to drive the first sub heater, and the first main heater is not driven while wash water stored in the first tube and wash water stored in the second tub are simultaneously heated.

11 Claims, 20 Drawing Sheets

(51) Int. Cl.

| | |
|---|---|
| ***D06F 33/00*** | (2020.01) |
| ***D06F 33/32*** | (2020.01) |
| ***D06F 33/72*** | (2020.01) |
| ***D06F 34/24*** | (2020.01) |
| ***D06F 34/28*** | (2020.01) |
| ***D06F 39/04*** | (2006.01) |
| *D06F 103/16* | (2020.01) |
| *D06F 103/38* | (2020.01) |
| *D06F 105/28* | (2020.01) |
| *D06F 105/58* | (2020.01) |

(52) U.S. Cl.

CPC ..... *D06F 34/24* (2020.02); *D06F 29/00* (2013.01); *D06F 31/00* (2013.01); *D06F 34/28* (2020.02); *D06F 39/04* (2013.01); *D06F 2103/16* (2020.02); *D06F 2103/38* (2020.02); *D06F 2105/28* (2020.02); *D06F 2105/58* (2020.02)

(56) References Cited

U.S. PATENT DOCUMENTS

| | | | |
|---|---|---|---|
| 2010/0138055 | A1 | 6/2010 | Jun et al. |
| 2011/0041258 | A1 | 2/2011 | Ko et al. |
| 2011/0252835 | A1 | 10/2011 | Beihoff et al. |
| 2014/0037808 | A1 | 2/2014 | Rizzuto et al. |
| 2016/0146471 | A1 | 5/2016 | Deng |
| 2016/0340819 | A1 | 11/2016 | Jang et al. |

FOREIGN PATENT DOCUMENTS

| | | | |
|---|---|---|---|
| CN | 102203337 | A | 9/2011 |
| CN | 104790168 | A | 7/2015 |
| CN | 105951405 | A | 9/2016 |
| CN | 106048968 | A | 10/2016 |
| EP | 1666654 | A2 | 6/2006 |
| EP | 1666654 | A3 | 6/2006 |
| JP | H-11244587 | A | 9/1999 |
| JP | 2006204714 | A | 8/2006 |
| JP | 2011062297 | A | 3/2011 |
| KR | 10-0778711 | B1 | 11/2007 |
| KR | 10-2008-0010047 | A | 1/2008 |
| KR | 10-2011-0019082 | A | 2/2011 |
| KR | 101025200 | B1 | 3/2011 |
| WO | 2016137181 | A3 | 9/2016 |

OTHER PUBLICATIONS

Supplementary European Search Report in connection with European Application No. 17899469.5 dated Nov. 29, 2019, 6 pages.

European Patent Office, "European Search Report" dated Feb. 22, 2021, in connection with European Patent Application No. 20214573.6, 8 pages.

Korean Intellectual Property Office, "Notice of Preliminary Rejection" dated May 12, 2021, in connection with Korean Patent Application No. 10-2017-0029465, 7 pages.

The First Office Action dated Apr. 27, 2021, in connection to Chinese Patent Application No. 201711460830.2, 20 pages.

Communication pursuant to Article 94(3) EPC dated Oct. 14, 2021, in connection with European Application No. 20214573.6, 4 pages.

Notice of Patent Allowance dated Nov. 21, 2021, in connection with Korean Application No. 10-2017-0029465, 3 pages.

WASHING MACHINE AND METHOD OF CONTROLLING THE SAME

CROSS-REFERENCE TO RELATED APPLICATIONS

This application is a divisional of U.S. patent application Ser. No. 15/856,869 filed on Dec. 28, 2017, which is based on and claims priority to Korean Patent Application No. 10-2017-0029465 filed on Mar. 8, 2017, the disclosures of which are herein incorporated by reference in their entirety.

TECHNICAL FIELD

Embodiments of the present disclosure relate to a washing machine including a plurality of washing apparatuses and a method of controlling the same.

BACKGROUND

In general, a washing machine refers to an apparatus used to wash laundry by rotating a cylindrical drum in which the laundry is contained. Washing machines are classified into washing machines in which a drum is horizontally disposed and laundry is washed while being lifted along an inner wall and tumbled down during rotation of the drum about a horizontal axis and washing machines in which a drum provided with a pulsator is vertically disposed and laundry is washed by using water streams generated by the pulsator while the drum rotates about a vertical axis.

The washing machines in which the drum is horizontally disposed are referred to as front-loading washing machines since a laundry loading port is formed at a front surface of the washing machines. The washing machines in which the drum is vertically disposed are referred to as top-loading washing machines since a laundry loading port is formed at an upper surface of the washing machines.

Washing machines generally wash laundry according to one of the two methods described above. Also, washing machines including a plurality of washing apparatuses driven in different methods have been introduced to obtain advantages methods described above.

SUMMARY

To address the above-discussed deficiencies, it is a primary object to provide a washing machine in which a first main heater is not driven while wash water stored in a first tub and wash water stored in a second tub are simultaneously heated, and a method of controlling the same.

Additional aspects of the disclosure will be set forth in part in the description which follows and, in part, will be obvious from the description, or may be learned by practice of the disclosure.

In accordance with one aspect of the present disclosure, a washing machine includes: a first tub configured to store wash water; a first main heater configured to heat wash water stored in the first tub; a first sub heater configured to heat wash water stored in the first tub; a second tub configured to store wash water; and a second heater configured to heat wash water stored in the second tub, wherein a power consumption required to drive the first main heater is greater than a power consumption required to drive the first sub heater, and the first main heater is not driven while wash water stored in the first tube and wash water stored in the second tub are simultaneously heated.

The first tub may be disposed under the second tub.

The first tub may be have a capacity of wash water greater than that of the second tub.

Wash water stored in the first tub and wash water stored in the second tub may be simultaneously heated to increase temperatures of wash water stored in the first tub and wash water stored in the second tub to a predetermined first target temperature and a predetermined second target temperature respectively.

When the temperature of wash water stored in the second tub reaches the second target temperature before the temperature of wash water stored in the first tub reaches the first target temperature, the first main heater and the first sub heater are simultaneously driven.

In accordance with another aspect of the present disclosure, a washing machine includes: a first tub configured to store wash water; a first main heater configured to heat wash water stored in the first tub; a first sub heater configured to heat wash water stored in the first tub; a second tub configured to store wash water; a second main heater configured to heat wash water stored in the second tub; and a second sub heater configured to heat wash water stored in the second tub, wherein a power consumption required to drive the first main heater is greater than a power consumption required to drive the first sub heater, a power consumption required to drive the second main heater is greater than a power consumption required to drive the second sub heater, and one of the first main heater and the first sub heater and one of the second main heater and the second sub heater are simultaneously driven when wash water stored in the first tub and wash water stored in the second tub are simultaneous heated.

Wash water stored in the first tub and wash water stored in the second tub may be simultaneously heated to increase temperatures of wash water stored in the first tub and wash water stored in the second tub to a predetermined first target temperature and a predetermined second target temperature respectively.

When the first target temperature is higher than the second target temperature, the first main heater and the second sub heater are simultaneously driven.

When the temperature of wash water stored in the second tub reaches the second target temperature before the temperature of wash water stored in the first tub reaches the first target temperature, the first main heater and the first sub heater are simultaneously driven.

When an amount of wash water stored in the first tub is greater than an amount of wash water stored in the second tub when wash water stored in the first tub and wash water stored in the second tub are simultaneous heated, the first main heater and the second sub heater are simultaneously driven.

In accordance with one aspect of the present disclosure, a method of controlling a washing machine comprising a first main heater configured to heat wash water stored in a first tub; a first sub heater configured to heat wash water stored in the first tub and operating with a power consumption lower than power consumption required to drive the first main heater; and a second heater configured to heat wash water stored in the second tub, the method includes: determining whether or not the second heater is in operation; and stopping driving of the first main heater upon determination that the second heater is in operation.

The method may further include simultaneously driving the first sub heater and the second heater upon determination that the second heater is in operation.

The simultaneously driving of the first sub heater and the second heater may be performed by simultaneously driving the first sub heater and the second heater to increase temperatures of wash water stored in the first tub and wash water stored in the second tub to a predetermined first target temperature and a predetermined second target temperature respectively.

The method may further include simultaneously driving the first main heater and the first sub heater when the temperature of wash water stored in the second tub reaches the second target temperature before the temperature of wash water stored in the first tub reaches the first target temperature.

The method may further include stopping heating of wash water stored in the second tub when the temperature of wash water stored in the second tub reaches the second target temperature before the temperature of wash water stored in the first tub reaches the first target temperature.

In accordance with another aspect of the present disclosure, a method of controlling a washing machine comprising a first main heater configured to heat wash water stored in a first tub; a first sub heater configured to heat wash water stored in the first tub and operating with a power consumption lower than power consumption required to drive the first main heater; a second main heater configured to heat wash water stored in the second tub; and a second sub heater configured to heat wash water stored in the second tub and operating with a power consumption lower than a power consumption required to drive the second main heater, the method includes: determining whether or not wash water stored in the first tub and wash water stored in the second tub need to be heated simultaneously; and simultaneously heating one of the first main heater and the first sub heater and one of the second main heater and the second sub heater upon determination that wash water stored in the first tub and wash water stored in the second tub need to be heated simultaneously.

The simultaneously heating of one of the first main heater and the first sub heater and one of the second main heater and the second sub heater may be performed by simultaneously heating one of the first main heater and the first sub heater and one of the second main heater and the second sub heater to increase temperatures of wash water stored in the first tub and wash water stored in the second tub to a predetermined first target temperature and a predetermined second target temperature respectively.

The simultaneously heating of one of the first main heater and the first sub heater and one of the second main heater and the second sub heater may be performed by simultaneously driving the first main heater and the second sub heater when the first target temperature is higher than the second target temperature.

The method may further include simultaneously driving the first main heater and the first sub heater when the temperature of wash water stored in the second tub reaches the second target temperature before the temperature of wash water stored in the first tub reaches the first target temperature.

The simultaneously heating of one of the first main heater and the first sub heater and one of the second main heater and the second sub heater may be performed by simultaneously driving the first main heater and the second sub heater when an amount of wash water stored in the first tub is greater than an amount of wash water stored in the second tub while wash water stored in the first tub and wash water stored in the second tub are simultaneously heated.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
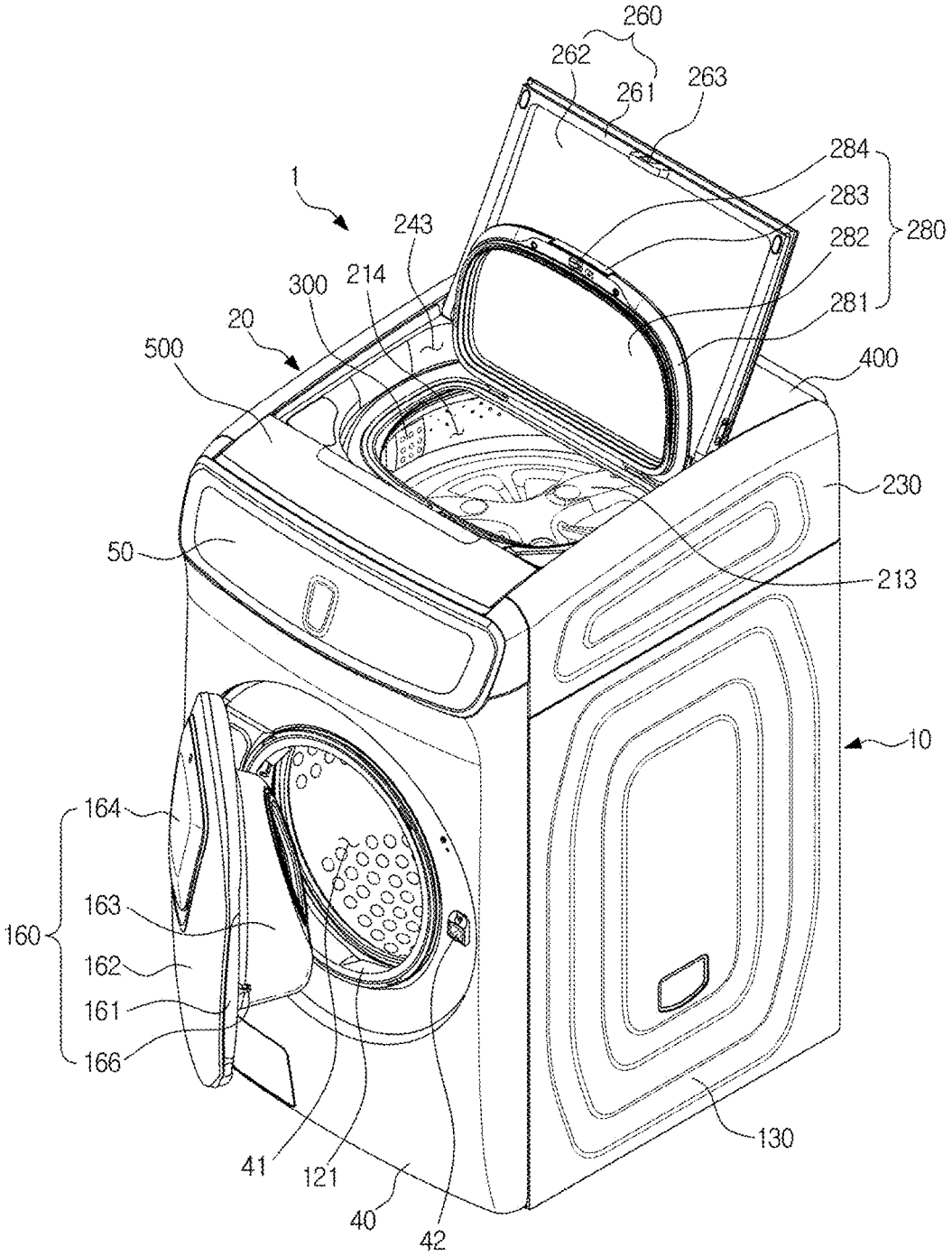
FIG. 1 is a perspective view of a washing machine according to an embodiment of the present disclosure.

FIGS. 1 through 15, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Reference will now be made in detail to the embodiments of the present disclosure, examples of which are illustrated in the accompanying drawings. The embodiments described in the specification and shown in the drawings are only illustrative and are not intended to represent all aspects of the invention, such that various modifications may be made without departing from the spirit of the invention.

In the drawings, like reference numerals denote like elements or components having substantially same functions.

The terms used in the present specification are merely used to describe particular embodiments, and are not intended to limit the present disclosure. An expression used in the singular encompasses the expression of the plural, unless it has a clearly different meaning in the context. In the present specification, it is to be understood that the terms such as "including" or "having", etc., are intended to indicate the existence of the features, numbers, operations, components, parts, or combinations thereof disclosed in the specification, and are not intended to preclude the possibility that one or more other features, numbers, operations, components, parts, or combinations thereof may exist or may be added.

It will be understood that, although the terms "first", "second", etc., may be used herein to describe various elements, these elements should not be limited by these terms. The above terms are used only to distinguish one component from another. For example, a first component discussed below could be termed a second component, and similarly, the second component may be termed the first component without departing from the teachings of this disclosure. As used herein, the term "and/or" includes any and all combinations of one or more of the associated listed items.

Hereinafter, embodiments of the present disclosure will be described in detail with reference to the accompanying drawings.

Figure 2:
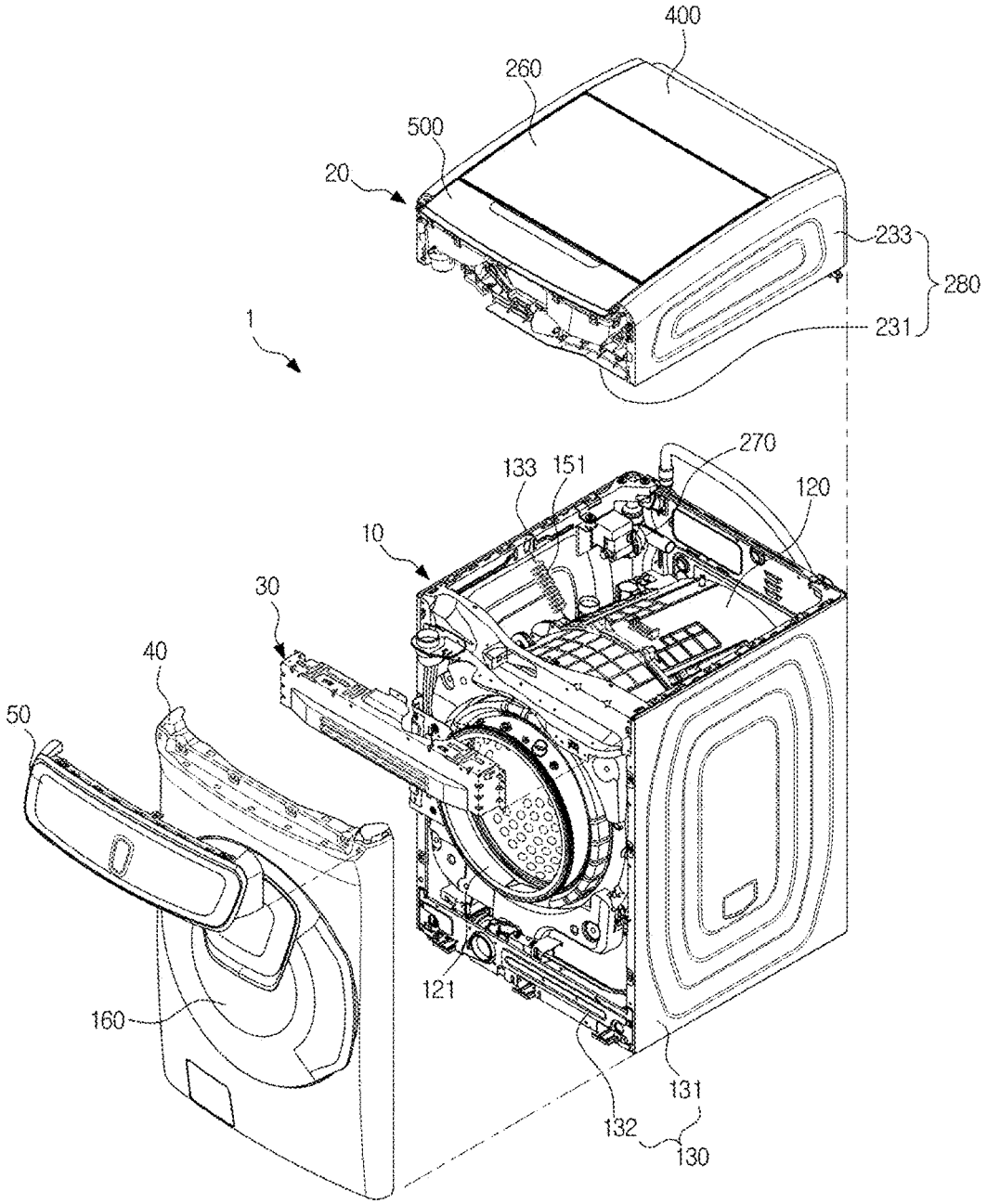
FIG. 2 is an exploded perspective view of the washing machine of FIG. 1 in which a first washing apparatus and a second washing apparatus are separated.
Figure 3:
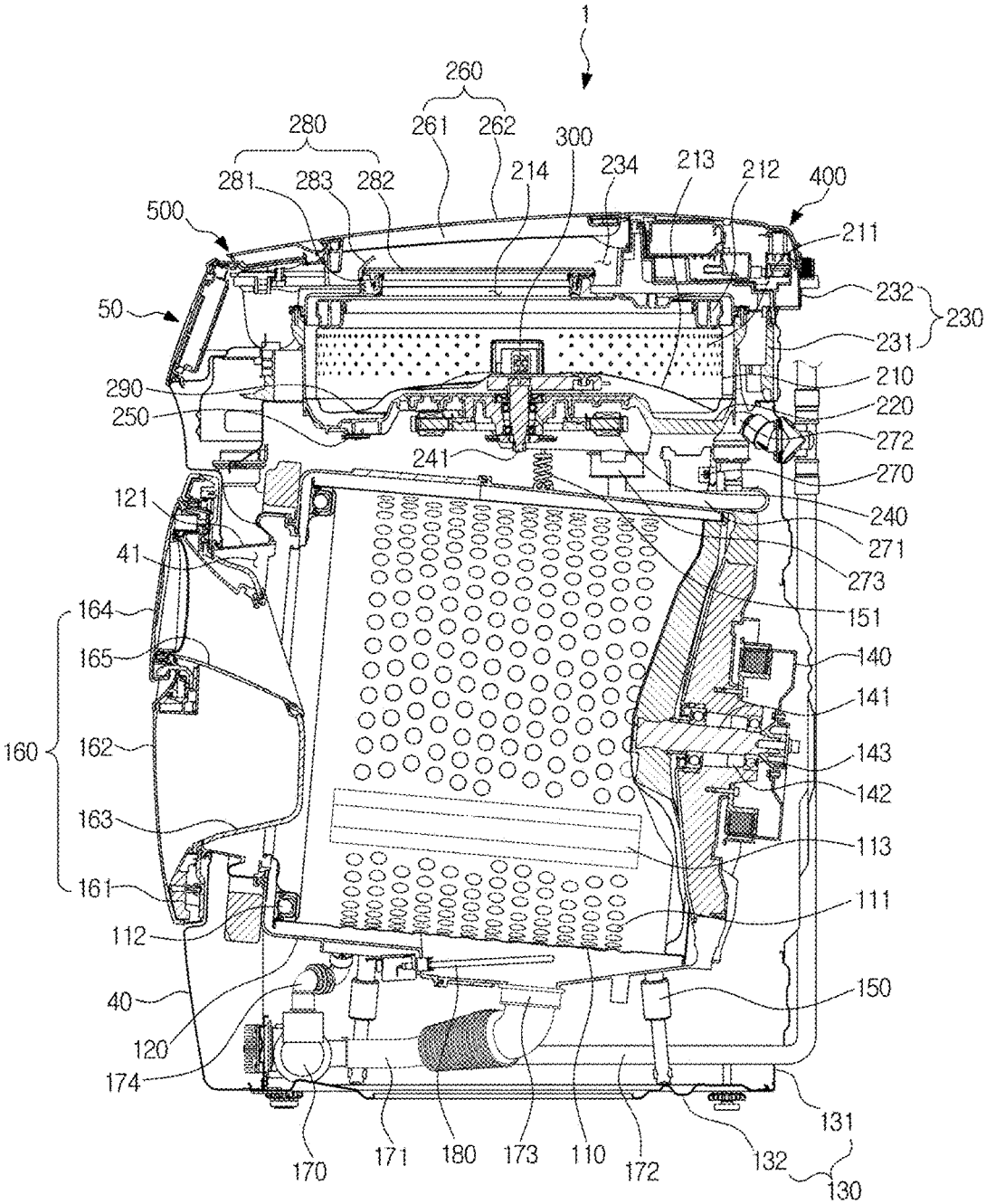
FIG. 3 is a cross-sectional view of the washing machine of FIG. 1.
Figure 4A:
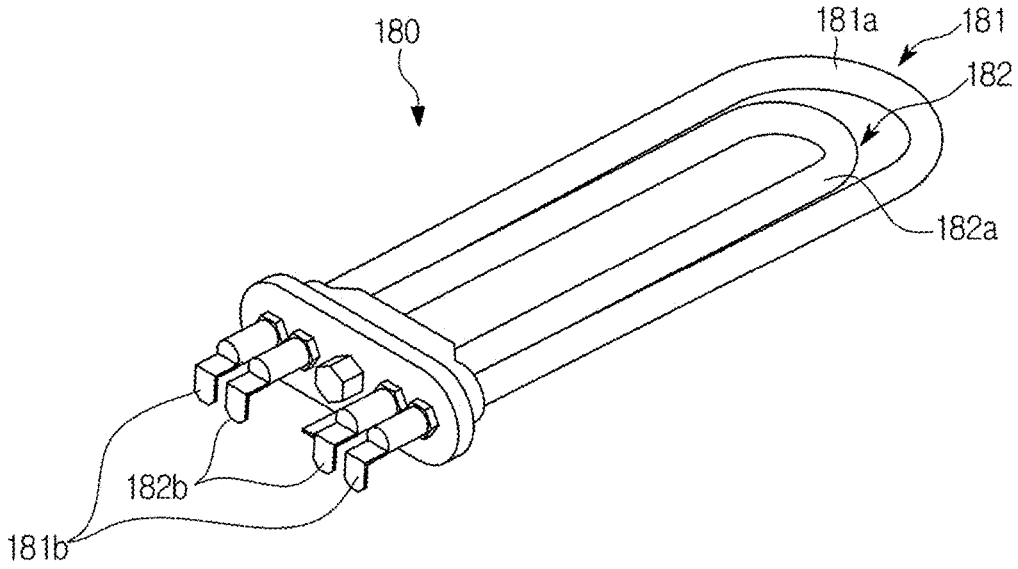
FIGS. 4A and 4B are perspective views of a first heater and a second heater of a washing machine according to an embodiment respectively.
Figure 4B:
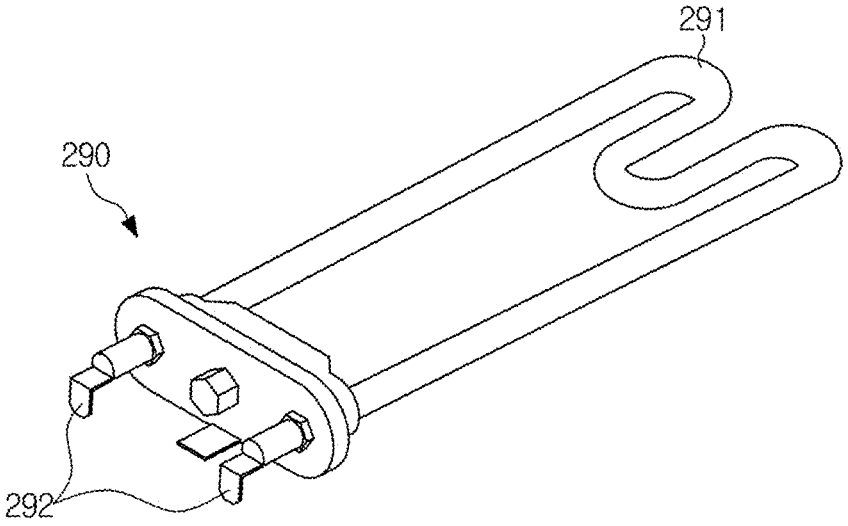
Figure 5A:
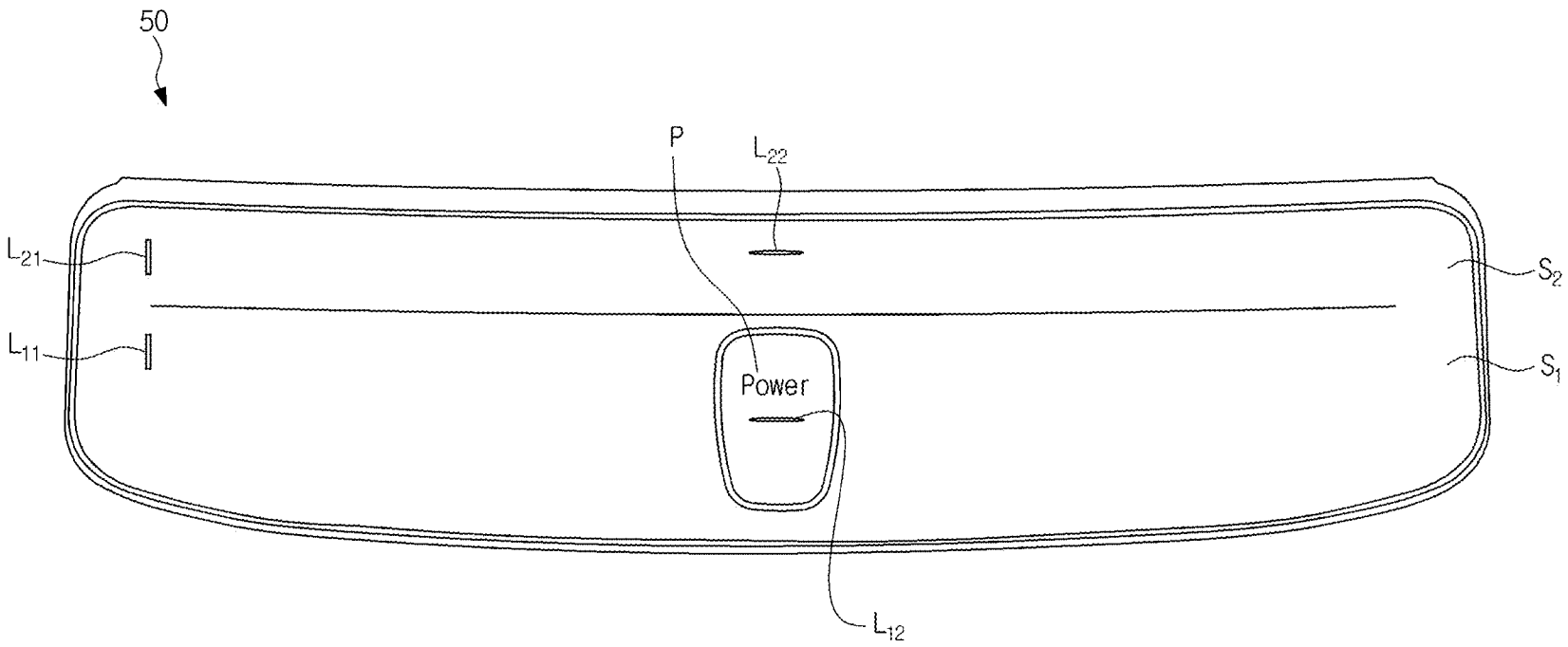
FIGS. 5A and 5B are views of a control panel according to an embodiment for describing changes in power on/off states.
Figure 5B:
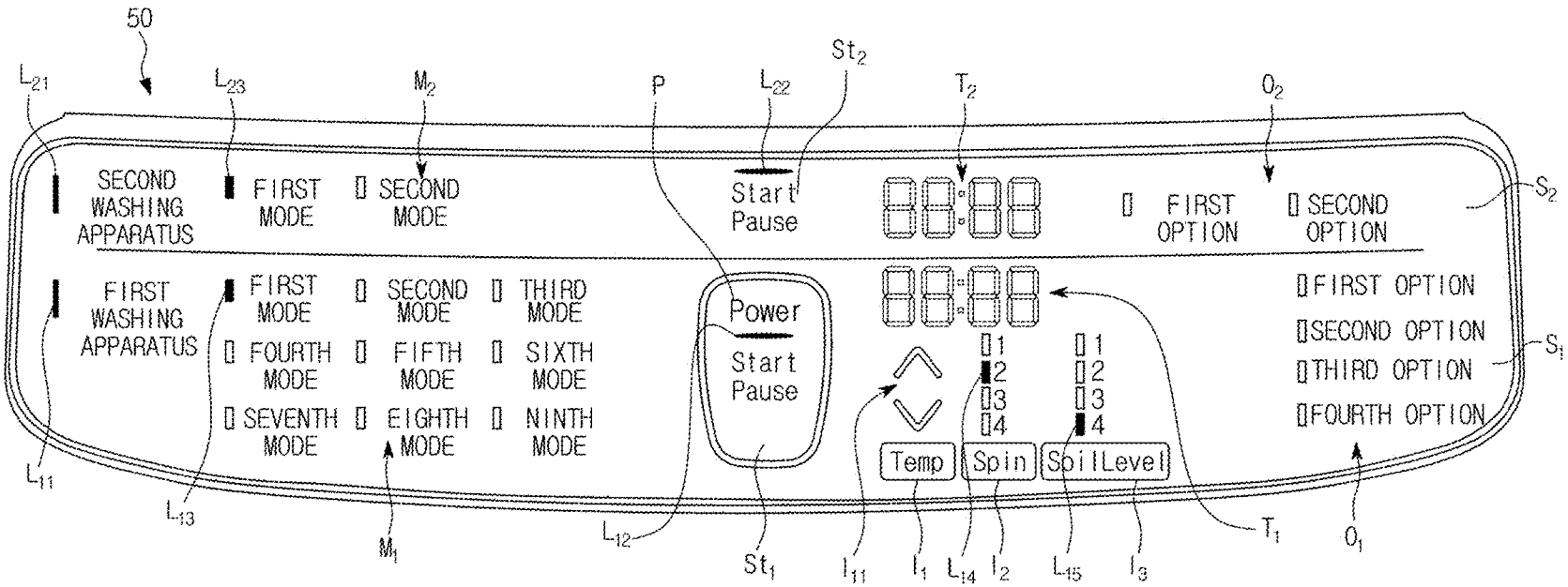

FIG. 1 is a perspective view of a washing machine according to an embodiment of the present disclosure. FIG. 2 is an exploded perspective view of the washing machine of FIG. 1 in which a first washing apparatus and a second washing apparatus are separated. FIG. 3 is a cross-sectional view of the washing machine of FIG. 1. FIGS. 4A and 4B are perspective views of a first heater and a second heater of a washing machine according to an embodiment respectively. FIGS. 5A and 5B are views of a control panel according to an embodiment for describing changes in power on/off states.

As illustrated in FIGS. 1 to 3, a washing machine 1 may include a front-loading type first washing apparatus 10 having a laundry loading port formed at a front portion and a top-loading type second washing apparatus 20 having a laundry loading port formed at a top portion. The second washing apparatus 20 may be disposed on the first washing apparatus 10.

The first washing apparatus 10 may include a first drum 110 having a first washing space therein and a first tub 120 that accommodates the first drum 110 and retains wash water or rinse water used in a washing cycle or a rinsing cycle. The first drum 110 and the first tub 120 may have a cylindrical shape with at least one portion of one surface being open which faces forward.

The first washing apparatus 10 may include a first housing 130. Specifically, the first housing 130 may include a side frame 131 defining side and rear appearances and a bottom frame 132 defining a bottom surface.

The first washing apparatus 10 may include a spring 151 and a damper 150 to support the first tub 120 with respect to the first housing 130. The damper 150 may support the first tub 120 under the first tub 120 by connecting an outer surface of the first tub 120 with the bottom frame 132. The spring 151 may support the first tub 120 at an upper portion of the first tub 120 by connecting the outer surface of the first tub 120 with a spring coupling portion 133 disposed at an upper portion of the side frame 131. The spring 151 and the damper 150 may relieve vibration, noise, and impact caused by movement of the first tub 120.

Installation positions of the spring 151 and the damper 150 are not limited to the upper end of the side frame 131 and the bottom frame 132. If required, the first tub 120 may be supported thereby by connecting one surface of the first tub 120 with one portion of the first housing 130.

The washing machine 1 may include a first drive motor 140 disposed behind the first tub 120 and configured to rotate the first drum 110. A first drive shaft 141 may be connected to a rear surface of the first drum 110 to transmit power of the first drive motor 140 thereto. A plurality of first through holes 111 may be formed through a peripheral wall of the first drum 110 to allow a flow of wash water therethrough. A plurality of lifters 113 may be installed on an inner surface of the peripheral wall of the first drum 110 to allow tumbling of laundry during rotation of the first drum 110. A first balancer 112 may be provided at a front end of the first drum 110 for stable rotation of the first drum 110 during high-speed rotation.

The first drive shaft 141 may be disposed between the first drum 110 and the first drive motor 140. One end of the first drive shaft 141 may be connected to a rear plate of the first drum 110 and the other end of the first drive shaft 141 may extend outwardly from a rear wall of the first tub 120. When the first drive motor 140 drives the first drive shaft 141, the first drum 110 connected to the first drive shaft 141 may rotate about the first drive shaft 141.

A bearing housing 142 may be disposed at the rear wall of the first tub 120 to rotatably support the first drive shaft 141. The bearing housing 142 may be formed of an aluminum alloy and inserted into the rear wall of the first tub 120 during injection molding of the first tub 120. Bearings 143 may be provided between the bearing housing 142 and the first drive shaft 141 for smooth rotation of the first drive shaft 141.

The first washing apparatus 10 may have a function of washing the laundry with hot water. In order to obtain hot water, a first heater 180 that heats wash water or rinse water contained in the first tub 120 may be provided at the bottom surface of the first tub 120.

The first heater 180 may generate heat by a first driving current supplied according to a first power consumption. To this end, the first heater 180 may include a first main heater 181 and a first sub heater 182 requiring different driving currents based on different power consumptions. Specifically, the first main heater 181 may be driven by a first main driving current based on a first main power consumption and the first sub heater 182 may be driven by a sub driving current based on a second sub power consumption lower than the first main power consumption. Referring to FIG. 4A, the first main heater 181 is disposed at an outer portion of the first heater 180 and the first sub heater 182 is disposed at an inner portion than the first main heater 181.

The first main heater 181 may include first main terminals 181*b* to supply the first main driving current according to the first main power consumption and a first main heat generating portion 181*a* to generate heat for heating wash water contained in the first tub 120 by the supplied first main driving current. The first sub heater 182 may include first sub terminals 182*b* to supply the first sub driving current according to the first sub power consumption and a first sub heat generating portion 182*a* to generate heat for heating wash water contained in the first tub 120 by the supplied first sub driving current.

Since the first main heater 181 and the first sub heater 182 include the first main terminals and the first sub terminals respectively, the first heater 180 may be driven such that the first main heater 181 and the first sub heater 182 operate simultaneously or selectively by changing the supply of the driving currents.

Particularly, while the second heater is in operation, the operation of the first main heater 181 of the first heater 180 may be stopped. This will be described later.

In addition, the first washing apparatus 10 may further include a temperature sensor (not shown) configured to sense a temperature of wash water or rinse water stored in the first tub 120.

The first washing apparatus 10 may include a first drain pump 170 disposed under the first tub 120 and configured to drain water contained in the first tub 120 out of the washing machine 1, a first connection hose 171 connecting a first drain hole 173 and the first drain pump 170 to allow water contained in the first tub 120 to flow into the first drain pump 170, a circulation hose 174 connecting the first drain pump 170 and the first tub 120 to circulate water introduced into the first drain pump 170 to the first tub 120, and a first drain hose 172 configured to guide water pumped by the first drain pump 170 out of the washing machine 1.

The washing machine 1 may further include a front cover 40 having a first laundry loading port 41 through which laundry is loaded into the first washing space. A first door 160 configured to open or close the first laundry loading port 41 may be coupled to the front cover 40.

The first door 160 may be formed to correspond to the first laundry loading port 41 and be pivotally rotatable about the front cover 40. The first door 160 may include a first door frame 161, a first door cover 162, and a door glass 163.

Although the first door frame 161 is formed in an approximately annular shape according to the present embodiment, the shape of the first door frame 161 may also be approximately rectangular. The first door cover 162 and the door glass 163 may be formed of a transparent material such that the inside of the first drum 110 is visible from the outside of the washing machine 1 even when the first door 160 closes the first laundry loading port 41. The door glass 163 may be disposed to protrude from the first door frame 161 toward the inside of the first drum 110. According to this configuration, when the first door 160 is closed, the door glass 163 may be inserted into the first laundry loading port 41.

A first hinge may be provided around the first laundry loading port 41 to allow the first door 160 to pivotally rotate about the front cover 40 and the first hinge is coupled to a first hinge coupling portion formed at one side of the first door frame 161. A first hook 166 may be provided at the other side of the first door frame 161 and the front cover 40 may have a first hook receiving portion 42 corresponding to the first hook 166. Thus, the first laundry loading port 41 may be maintained in a state of being closed by the first door 160.

The first door 160 may include an auxiliary laundry loading port and an auxiliary door 164 configured to open or close the auxiliary laundry loading port such that laundry is loaded into the first washing space even when the first door 160 is closed. The auxiliary door 164 may be rotatably mounted to the first door cover 162.

In order to load laundry into the washing machine 1 through the auxiliary laundry loading port of the first door 160, the laundry should pass through the door glass 163. To this end, the door glass 163 may have a glass through hole. Alternatively, an upper portion of the door glass 163 may be recessed such that the door glass 163 is not disposed behind the auxiliary laundry loading port.

The first door 160 may have a connection guide part 165 to connect the auxiliary laundry loading port of the first door 160 and the glass through hole of the door glass 163. The connection guide part 165 may be formed in a hollow tubular shape having both open ends.

Specifically, one end of the connection guide part 165 may be connected to the auxiliary laundry loading port and the other end may be connected to the glass through hole. According to the present embodiment, the connection guide part 165 may be inclined downward from the front to the rear. That is, the one end of the connection guide part 165 connected to the auxiliary laundry loading port may be positioned higher than the other end thereof. According to this configuration, a user may easily load the laundry into the first drum 110 through the auxiliary laundry loading port.

Although the first door 160 includes the auxiliary door 164 according to the present embodiment, the present disclosure is not limited thereto and the first door 160 may be configured without having the auxiliary laundry loading port, the auxiliary door, and the connection guide part.

The first washing apparatus 10 may include a diaphragm 121 disposed between the first laundry loading port 41 of the front cover 40 and an opening of the first tub 120. The diaphragm 121 may form a pathway from the first laundry loading port 41 to the opening of the first tub 120 and decrease vibration transmitted to the front cover 40 during rotation of the first drum 110. Also, one portion of the diaphragm 121 may be disposed between the first door 160 and the front cover 40 to prevent leakage of wash water stored in the first tub 120 out of the washing machine 1.

The second washing apparatus 20 may include a second drum 210 having a second washing space therein and a second tub 220 that accommodates the second drum 210 and retains wash water or rinse water used in a washing cycle or a rinsing cycle. The second drum 210 and the second tub 220 may have a cylindrical shape with at least one portion of one surface being open which faces upward.

The second washing apparatus 20 may include a second housing 230. Specifically, the second housing 230 may include a lower frame 231 configured to support the second tub 220 and an upper frame 232 having a second laundry loading port 234 through which laundry is loaded into the second washing space and seated on the lower frame 231. The second housing 230 may further include a side cover 233 defining left and right side appearances of the second housing 230.

The second washing apparatus 20 may include a second door 260 configured to open or close the second laundry loading port 234. The second door 260 may be formed so as to correspond to the second laundry loading port 234 and be pivotally rotatable with respect to the upper frame 232. The second door 260 may include a second door frame 261 and a second door cover 262. The second door cover 262 may be formed of a transparent material such that the inside of the second tub 220 and the second drum 210 is visible from the outside of the washing machine 1 even when the second door 260 closes the second laundry loading port 234.

Second hinges may be provided at the left and right sides of the second door frame 261 to allow the second door 260 to pivotally rotate about the upper frame 232 and the second hinges are coupled to second hinge coupling portions formed around the second laundry loading port 234. Since a latch receiving part 263 is provided at a front portion of the second door frame 261 and a latch unit is provided at the upper frame 232 to correspond to the latch receiving part 263 of the second door frame 261, the second laundry loading port 234 may be maintained in a state of being closed by the second door 260 while the second washing apparatus 20 operates.

The second drum 210 may be provided in a cylindrical shape having an open top surface and rotatable in the second tub 220. A plurality of second through holes 211 may be formed through a side surface and/or a bottom surface of the second drum 210 to allow a flow of wash water therethrough. A second balancer 212 may be mounted at an upper portion of the second drum 210 for stable rotation of the second drum 210 during high-speed rotation. A filter 300 may be attached to the inner side surface of the second drum 210 so as to remove foreign substances during washing.

A curved portion 213 to generate water streams may be formed on the bottom surface of the second drum 210. Although not shown in the drawings, the second washing apparatus 20 may further include a pulsator disposed in the second drum 210 to generate water streams.

The second tub 220 may have a cylindrical shape and be supported by the lower frame 231 using a suspension 250. Specifically, the second tub 220 may be supported in a state of being hung at the lower frame 231 by four suspensions 250. The second drum 210 may have a third laundry loading port 214 at a top surface thereof to correspond to the second laundry loading port 234 and a third door 280 may be coupled thereto to open or close the third laundry loading port 214.

In addition, the second tub 220 may have a capacity of wash water different from that of the first tub 120. Specifically, the second tub 220 may have a smaller capacity of wash water than that of the first tub 120. As a result, the user may select one of the first tub 120 and the second tub 220 according to a required amount of wash water.

The third door 280 may include a third door frame 281 and a third door cover 282. The third door cover 282 may be formed of a transparent material such that the inside of the second drum 210 is visible from the outside of the second tub 220 even when the third door 280 closes the third laundry loading port 214.

A third hinge may be provided around a third laundry loading port 214 such that the third door 280 pivotally rotates about the second tub 220 and coupled to a third hinge coupling portion formed at one side of the third door frame 281. A handle 283 to open or close the third door 280 may be provided at the other side of the third door frame 281 and a second hook 284 may be provided at the handle 283. A second hook receiving part may be disposed at the second tub 220 to correspond to the second hook 284, so that the third laundry loading port 214 may be maintained in a state of being closed by the third door 280. When the handle 283 is pulled, the second hook 284 is disengaged from the second hook receiving part to open the third door 280.

The second washing apparatus 20 may further include a second drive motor 240 disposed under an outer surface of the second tub 220 and configured to rotate the second drum 210. A second drive shaft 241 may be connected to a bottom surface of the second drum 210 to transmit power of the second drive motor 240 thereto. One end of the second drive shaft 241 may be connected to a bottom plate of the second drum 210 and the other end of the second drive shaft 241 may extend outwardly from a lower wall of the second tub 220. When the second drive motor 240 drives the second drive shaft 241, the second drum 210 connected to the second drive shaft 241 may rotate about the second drive shaft 241.

Although not shown in the drawings, when the pulsator is disposed on the bottom surface of the second drum 210, the washing machine 1 may further include a power switching device to transmit power generated by the second drive motor 240 to the second drum 210 and the pulsator simultaneously or selectively.

The second washing apparatus 20 may have a function of washing the laundry with hot water. In order to obtain hot water, a second heater 290 that heats wash water or rinse water contained in the second tub 220 may be provided at a bottom surface of the second tub 220.

The second heater 290 may generate heat by a second driving current supplied thereto. To this end, referring to FIG. 4B, the second heater 290 may include second terminals 292 to supply the second driving current and a second heat generating portion 291 to generate heat for heating wash water stored in the second tub 220 by the supplied second driving current. The second heat generating portion 291 have a plurality of bent portions so as to maximize heat generating effects in a given space.

A second drain pump 270 configured to drain water stored in the second tub 220 out of the washing machine 1 may be disposed in the first washing apparatus 10. Specifically, the first washing apparatus 10 may include the second drain pump 270 disposed at an upper portion of the first housing 130 and a second drain hose 272 configured to guide water pumped by the second drain pump 270 out of the washing machine 1.

A second drain hole 273 configured to drain water from the second tub 220 may be disposed at the bottom surface of the second tub 220 and the second drain hole 273 may be connected to the second drain pump 270 via a second connection hose 271 to allow water stored in the second tub 220 to flow into the second drain pump 270.

The second washing apparatus 20 may further include a water supply device 400 to supply wash water to the second tub 220 and the first tub 120 of the first washing apparatus 10. The water supply device 400 may be disposed at the second housing 230. Specifically, the water supply device 400 may be disposed at the upper frame 232, preferably behind the second loading port 234.

The second washing apparatus 20 may further include a detergent supply device 500 to supply a detergent to the first washing apparatus 10. The detergent supply device 500 may be disposed at the second housing 230. Particularly, the detergent supply device 500 may be disposed at the upper frame 232, preferably in front of the second loading port 234.

The washing machine 1 may further include a control panel 50 disposed at an upper portion of the front cover 40 to operate the first washing apparatus 10 and the second washing apparatus 20. The control panel 50 may include an input unit 51 to receive a command to operate the washing machine 1 from a user and a display unit 52 to display operation information of the washing machine 1. In this case, the input unit 51 and the display unit 52 may be implemented using one touchscreen.

Hereinafter, the embodiment will be described based on a case where the control panel 50 is implemented using a touchscreen for descriptive convenience.

FIG. 5A is a view illustrating a control panel 50 when a washing machine 1 according to an embodiment is turned off.

Referring to FIG. 5A, the control panel 50 may be divided into a first section S1 for displaying various information about the first washing apparatus 10 and a second section S2 for displaying various information about the second washing apparatus 20.

In addition, a power icon P configured to control On/Off operation of power of the washing machine 1 may be displayed at the center of the control panel 50. When the power icon P is touched, the control panel 50 may receive a power Turn-On command.

FIG. 5B is a view illustrating the control panel 50 when the washing machine 1 is turned on.

When the power Turn-On command is input by touching the power icon P, power may be supplied to the washing machine 1. As a result, the control panel 50 may display various selectable objects.

Referring to FIG. 5B, the first section S1 may include a start icon St1 to start or stop washing of the first washing apparatus 10, a mode icon M1 to select a washing mode performed by the first washing apparatus 10, an option icon O1 to select an option additionally performed while a selected washing mode is performed, a target temperature setting environment entry icon I1 to enter an environment of setting a target temperature of wash water of the first washing apparatus 10, a target temperature setting icon I11 to set a target temperature after entering the target temperature setting environment, a rotation speed icon I2 to select a rotation speed of the first drum of the first washing apparatus 10, a contamination level icon I3 to select the degree of contamination of the laundry contained in the first washing apparatus 10, a number information display region T1 to display various number information related to the first washing apparatus 10, and the like.

The first section S1 may further include activation indicators L11 and L12 to indicate an activation state, a selected mode indicator L13 to indicate a selected mode, a selected rotation speed indicator L14 to indicate a selected rotation speed of the first drum, a selected contamination level indicator L15 to indicate a selected degree of contamination of the laundry contained in the first washing apparatus 10, and the like.

In addition, the second section S2 may include a start icon St2 to start or stop washing of the second washing apparatus 20, a mode icon M2 to select a washing mode of the laundry contained in the second washing apparatus 20, an option icon O2 to select an option additionally performed while a selected washing mode is performed, a number information display region T2 to display various number information related to the second washing apparatus 20, and the like.

The second section S2 may further include activation indicators L21 and L22 to indicate an active state, a selected mode indicator L23 to indicate a selected mode, and the like.

When the power Turn-On command is input, the control panel 50 may activate both of the first section S1 and the second section S2 and deactivate the activated sections where another touch is not sensed within a predetermined period of time. When another touch is sensed in the first section S1 or the second section S2 after deactivation, the control panel 50 may re-activate the sensed section.

Meanwhile, the aforementioned washing machine 1 may supply power, which is supplied through one power supply cable, to the first washing apparatus 10 and the second washing apparatus 20 respectively. At this time, the power supply cable to supply power has a limit current enabling a normal operation and the limit current may be preset at the time of manufacture. Also, an electrical outlet to which the power supply cable is directly connected may also have a limit current. In addition, a current breaker provided on the path for transmitting the power supplied from the outside to in-house electrical outlets has a breaking current and may cut off the power supply path when a current exceeding the breaking current flows.

As a result, there is a need to supply a current less than a reference current, which is a minimum value among the limit current of the power supply cable, the limit current of the electrical outlets connected to the power supply cable, and the breaking current of the in-house current breaker, to the washing machine 1 according to an embodiment.

However, when the washing machine 1 includes a plurality of washing apparatuses, a current greater than the reference current may be required. Specifically, a current required to simultaneously drive the heaters provided in the plurality of washing apparatuses may be greater than the reference value. In this case, the power supply cable may not perform a normal operation due to an overcurrent, the outlet connected to the power supply cable may be out of order, or the current supplied to the washing machine 1 may be cut off by the in-house current breaker.

Thus, the washing machine 1 according to the present embodiment may control the operation of the first heater 180 and the second heater 290 to stably supply a current less than a predetermined reference current. Hereinafter, a washing machine 1 that controls the first heater 180 and the second heater 290 to prevent the supply of an overcurrent in advance will be described.

Figure 6A:
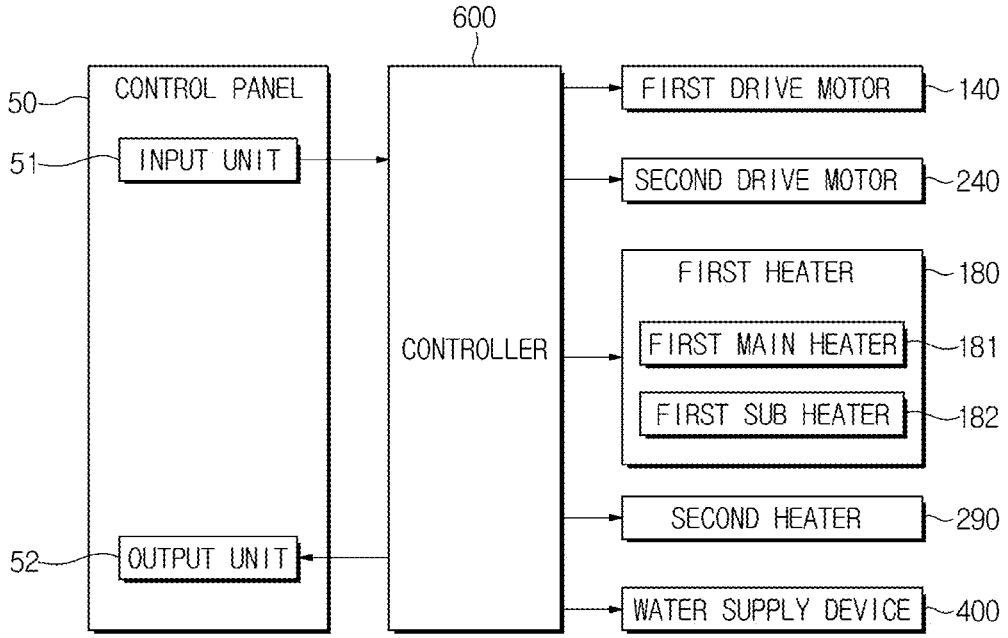
FIGS. 6A and 6B are a control block diagram of a washing machine according to various embodiments.
Figure 6B:
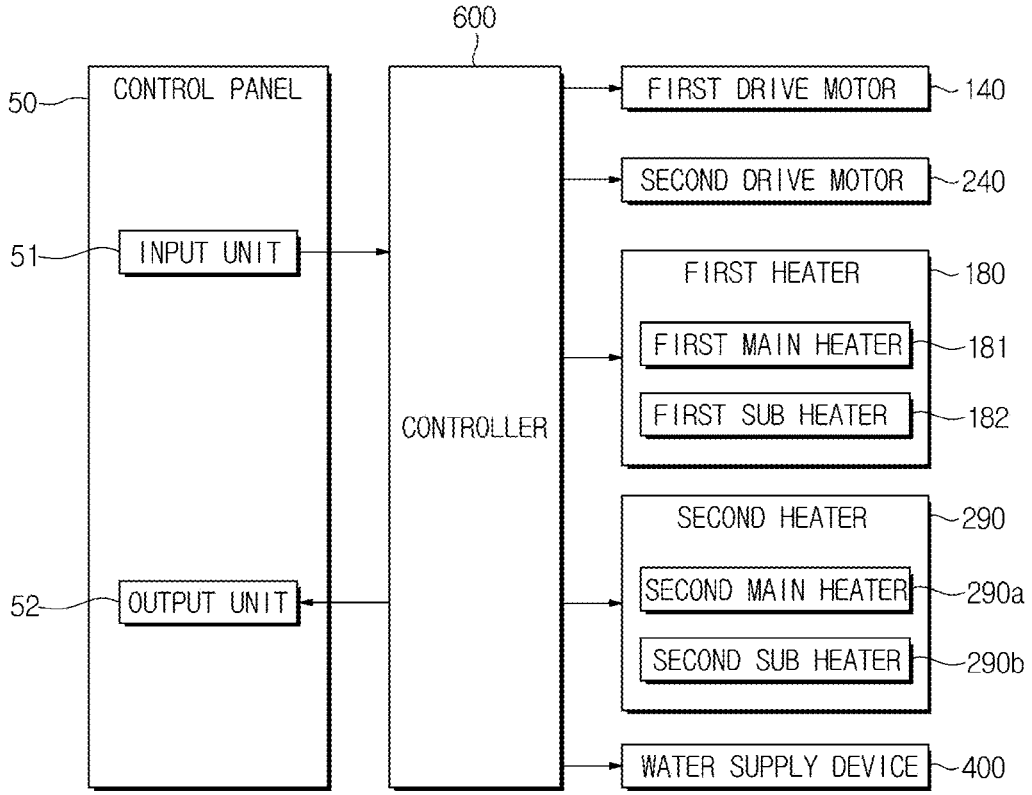

FIG. 6A is a control block diagram of a washing machine according to an embodiment. FIG. 6B is a control block diagram of a washing machine according to another embodiment.

Referring to FIG. 6A, a washing machine 1 according to an embodiment may include a first drive motor 140 configured to provide a rotational force to the first tub of the first washing apparatus 10, a second drive motor 240 configured to provide a rotational force to the second tub of the second washing apparatus 20, a first heater 180 configured to heat wash water stored in the first tub of the first washing apparatus 10, a second heater 290 configured to heat wash water stored in the second tub of the second washing apparatus 20, a water supply device 400 configured to supply wash water to one of the first tub and the second tub, a control panel 50 configured to perform input and output operations with regard to the washing machine 1, and a controller 600 configured to control each of the elements of the washing machine 1.

The first drive motor 140, the second drive motor 240, the first heater 180, the second heater 290, the water supply device 400, the first main heater 181, and the control panel 50 illustrated in FIG. 6A are as described above with reference to FIGS. 1 to 3, 4A, 4B, 5A, and 5B. Hereinafter, a method of controlling the first heater 180 and the second heater 290 to prevent the supply of an overcurrent in advance will be described based on the operation of the controller 600.

While the second heater 290 is in operation, the controller 600 may prevent an overcurrent from being supplied to the washing machine 1 in advance by driving one of the first main heater 181 and the first sub heater.

Hereinafter, a method of controlling the operation of the first heater 180 and the second heater 290 performed by the controller 600 while the second heater 290 is in operation will be described with reference to FIGS. 7A, 7B, 8, and 9.

Figure 7A:
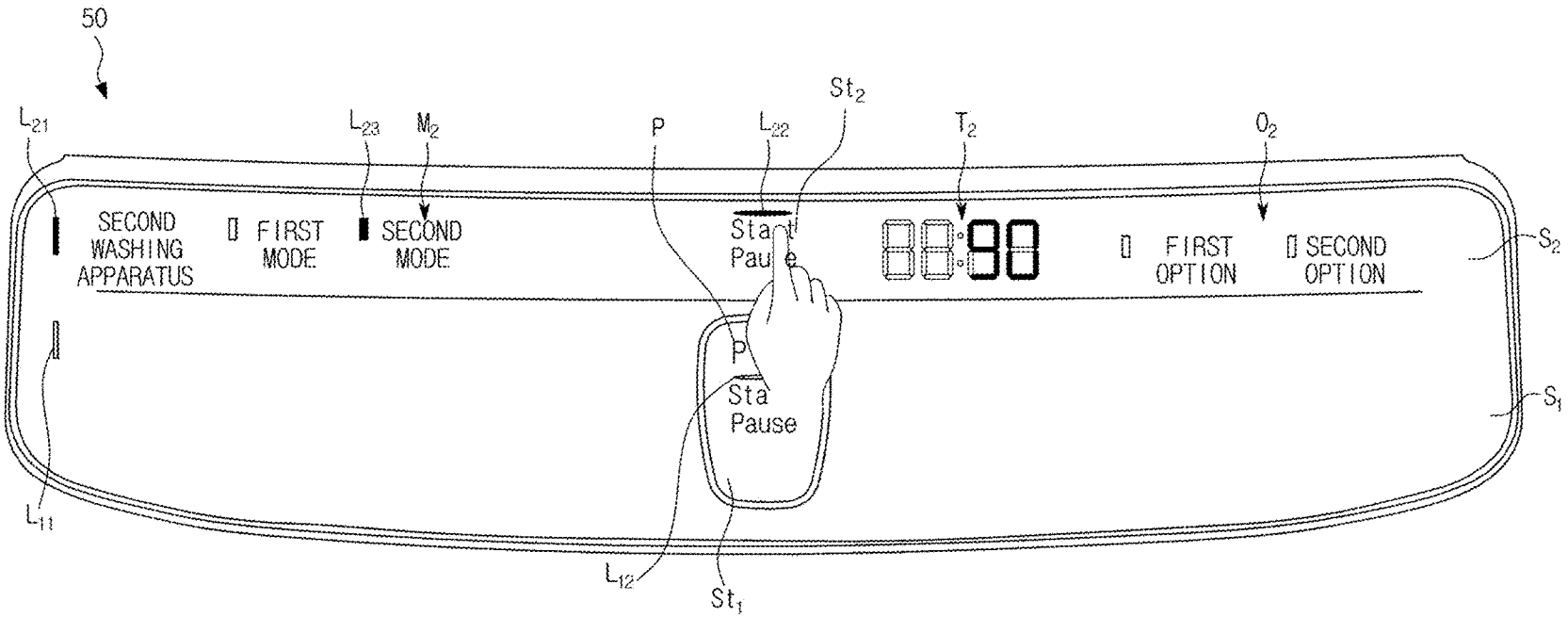
FIGS. 7A and 7B are views for exemplarily describing a case where a command to drive the first heater is input through a control panel while a second heater is in operation.
Figure 7B:
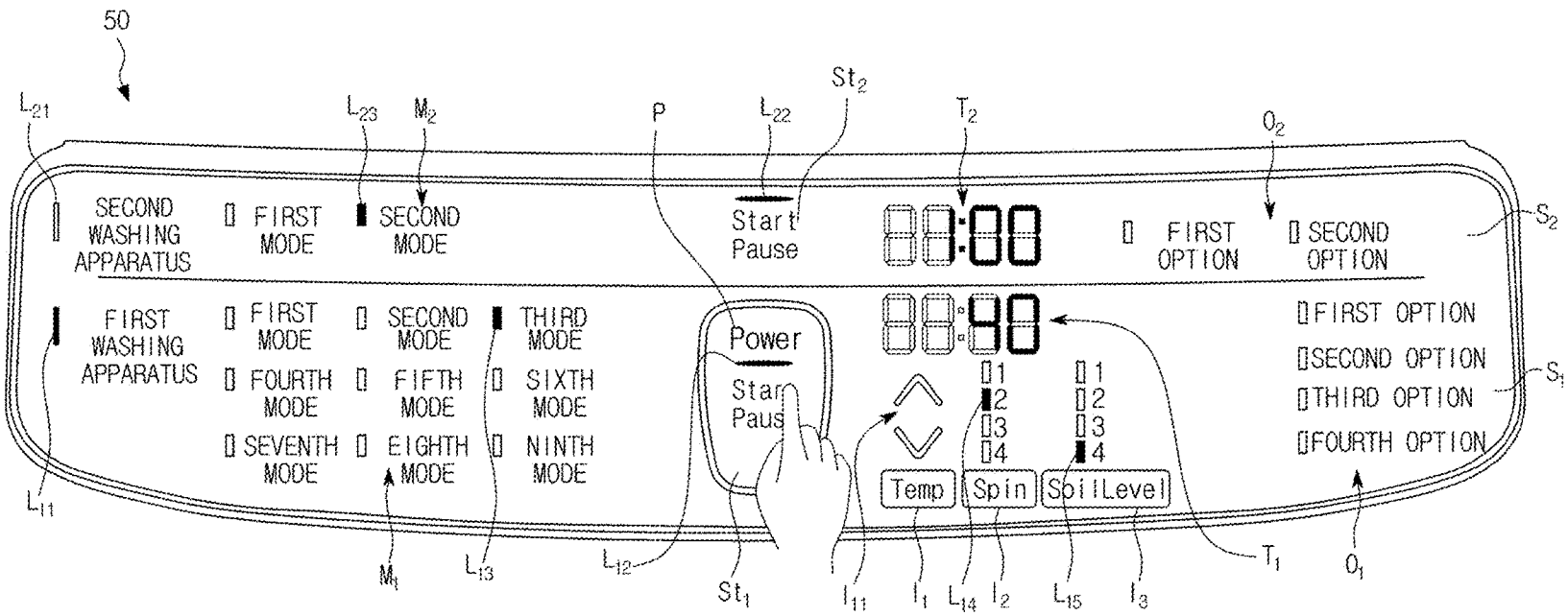

FIGS. 7A and 7B are views for exemplarily describing a case where a command to drive the first heater is input through a control panel while a second heater is in operation.

FIG. 7A is a view illustrating a control panel in which the second section S2 is in an active state and the first section S1 is in an inactive state. Referring to FIG. 7A, it is confirmed that a second mode is selected for the second washing apparatus 20 and no option is selected. Since the second heater 290 is driven when the second mode is selected as described above, a second target temperature for wash water stored in the second tub may be displayed at the number information display region T2. FIG. 7A exemplarily illustrates a case where the second target temperature is set to 90° C.

When a wash start command for the second washing apparatus 20 is input by the user by touching the start icon St2 of the control panel 50, the second washing apparatus 20 may perform washing in accordance with the set mode. As a result, the controller 600 of the second washing apparatus 20 may drive the second heater 290 to increase a temperature of wash water stored in the second tub to the second target temperature according to the second mode. Specifically, the controller 600 may supply a second driving current corresponding to the second target temperature of the second mode to the second heater 290 and the second heater 290 may heat wash water by the supplied second driving current.

A touch on the first section S1 of the control panel 50 may be sensed while the second heater 290 is in operation and the first section S1 may be activated by the touch. FIG. 7B is a view exemplarily illustrating a case in which the first section S1 is in an active state. Referring to FIG. 7B, it may be confirmed that a third mode is selected for the first washing apparatus 10 by the user via the control panel 50 and no option is selected. It may also be confirmed that a first target temperature for wash water stored in the first tub 120 of the first washing apparatus 10 is set to 40° C.

Upon completion of the setting, the user may input a wash start command for the first washing apparatus 10 by touching the start icon SU of the control panel 50. When the wash start command for the first washing apparatus 10 is input, the first washing apparatus 10 performs washing according to the set mode. As a result, the controller 600 may drive the first heater 180 to heat wash water stored in the first tub 120 to increase a temperature of wash water to the first target temperature according to the third mode.

In this case, since the washing machine 1 is receiving the second driving current for driving the second heater 290, the controller 600 may control the first heater 180 to supply a driving current to the first heater 180 such that the current supplied to the washing machine 1 does not exceed the reference current.

Figure 8:
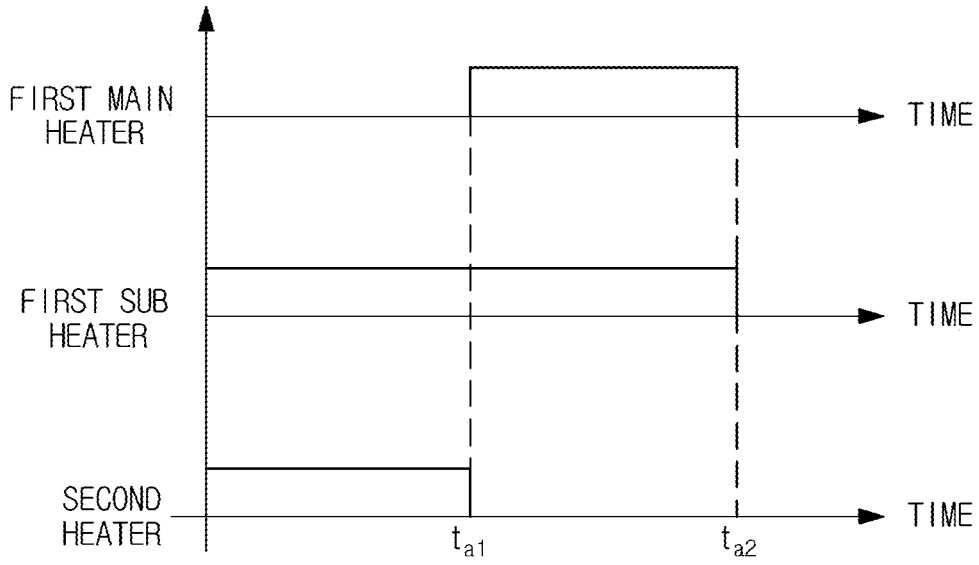
FIG. 8 is a graph exemplarily illustrating driving currents supplied to each of the heaters with time while a second heater is in operation according to an embodiment.

FIG. 8 is a graph exemplarily illustrating driving currents supplied to each of the heaters with time while a second heater is in operation according to an embodiment.

First, a second driving current may be supplied to the second heater 290 to heat wash water stored in the second tub 220. As a result, the second heater 290 may be driven by the second driving current.

In this case, not only wash water stored in the second tub 220 but also wash water stored in the first tub 120 may be simultaneously heated. For example, when a wash start command for the first washing apparatus 10 including a command to drive the first heater 180 is input while the second heater 290 is in operation, the controller 600 may control the first sub heater 182 to be driven only without driving the first main heater 181 of the first heater 180. Specifically, the controller 600 may cut off the first main driving current supplied to the first main heater 181 and may supply only the second sub driving current to the first sub heater 182.

As a result, a total amount of currents supplied to the washing machine 1 is a sum of the first sub driving current and the second driving current which may be set to the predetermined reference current or less.

Referring to FIG. 8, wash water of the first tub 120 and second tub 220 may be heated by driving the second heater 290 to which the second driving current is supplied and the first sub heater 182 to which the first sub driving current is supplied.

When a temperature of wash water of the second tub 220 reaches the second target temperature at a time point ta1, the controller 600 may stop the operation of the second heater 290. Specifically, the controller 600 may stop the supply of the second driving current to the second heater 290.

Simultaneously or sequentially, the controller 600 may start driving of the first main heater 181. That is, the controller 600 may simultaneously drive the first main heater 181 and the first sub heater 182 of the first heater 180 by resuming the supply of the first main driving current, which has been cut off, to the first main heater 181.

In this case, a total amount of currents supplied to the washing machine 1 is a sum of the first main driving current and the first sub driving current which may be set to be the predetermined reference current or less.

When the temperature of wash water of the first tub 120 reaches the first target temperature at a time point ta2 as a result of driving the first main heater 181 and the first sub heater 182, the controller 600 may stop the operation of the first main heater 181 and the first sub heater 182.

The controller 600 may also control driving of the first heater 180 and the second heater 290 in a different manner from that described above.

Figure 9:
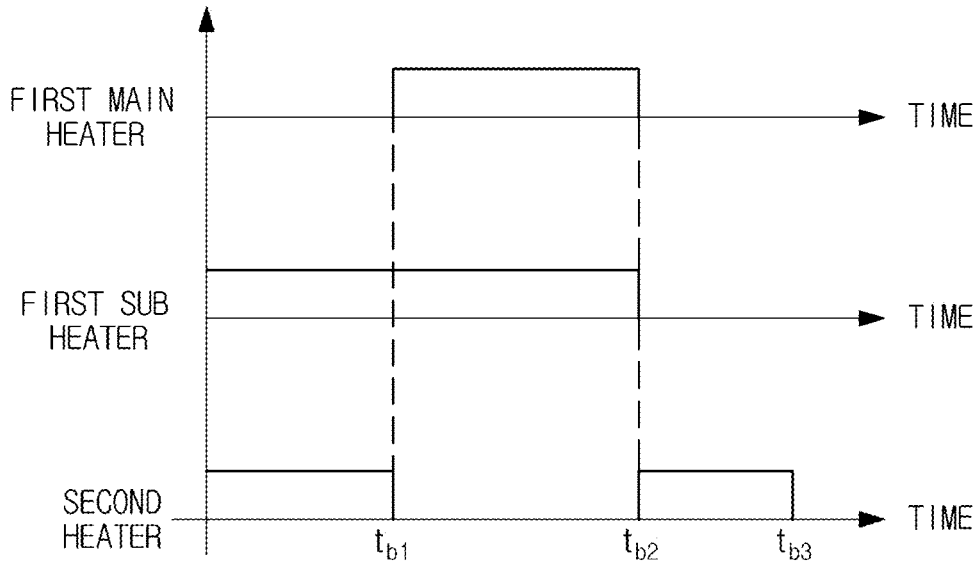
FIG. 9 is a graph exemplarily illustrating driving currents supplied to each of the heaters with time while a second heater is in operation according to another embodiment.

FIG. 9 is a graph exemplarily illustrating driving currents supplied to each of the heaters with time while a second heater is in operation according to another embodiment.

First, a second driving current may be supplied to the second heater 290. As a result, the second heater 290 may be driven by the second driving current.

When a wash start command for the first washing apparatus 10 including a command to drive the first heater 180 is input while the second heater 290 is in operation, the controller 600 may stop the operation of the first main heater 181 of the first heater 180 and control the first sub heater 182 to be driven only. Specifically, the controller 600 may cut of the first main driving current supplied to the first main heater 181 and supply only the first sub driving current to the first sub heater 182.

As a result, a total amount of currents supplied to the washing machine 1 is a sum of the first sub driving current and the second driving current which may be set to the predetermined reference current or less.

Referring to FIG. 9, wash water of the first tub 120 and the second tub 220 may be heated by driving the second heater 290 to which the second driving current is supplied and the first sub heater 182 to which the first sub driving current is supplied.

The controller 600 may stop the operation of the second heater 290 at a time point tb1 after a predetermined period of time while the second heater 290 and the first sub heater 182 are in operation. Specifically, the controller 600 may stop the supply of the second driving current to the second heater 290. In this regard, the predetermined period of time refers to a time for pre-heating wash water stored in the second tub 220 and may be determined by an external input or internal calculation of the washing machine 1.

Simultaneously or sequentially, the controller 600 may start driving of the first main heater 181. That is, the controller 600 may simultaneously drive the first main heater 181 and the first sub heater 182 of the first heater 180 by resuming the supply of the first main driving current, which has been cut off, to the first main heater 181.

In this case, a total amount of currents supplied to the washing machine 1 is a sum of the first main driving current and the first sub driving current which may be set to be the predetermined reference current or less.

When the temperature of wash water of the first tub 120 reaches the first target temperature at a time point ta2 as a result of driving the first main heater 181 and the first sub heater 182, the controller 600 may stop the operation of the first main heater 181 and the first sub heater 182.

The controller 600 may restart driving of the second heater 290 simultaneously or sequentially with the stopping of the driving of the first main heater 181 and the first sub heater 182. Since wash water stored in the second tub 220 is pre-heated by previously driving the second heater 290, the temperature of wash water of the second tub 220 may reach the second target temperature at an earlier time point tb3. When the temperature of wash water stored in the second tub 220 is higher than the second target temperature, the controller 600 may stop the driving of the second heater 290.

Thus, the washing machine 1 may pre-heat wash water stored in the second tub 220 and contaminants may be easily separated from the laundry by using the pre-heated wash water.

The method of controlling the heaters while the second heater is in operation has been described. Hereinafter, a method of controlling the heaters while the first heater is driven.

Figure 10A:
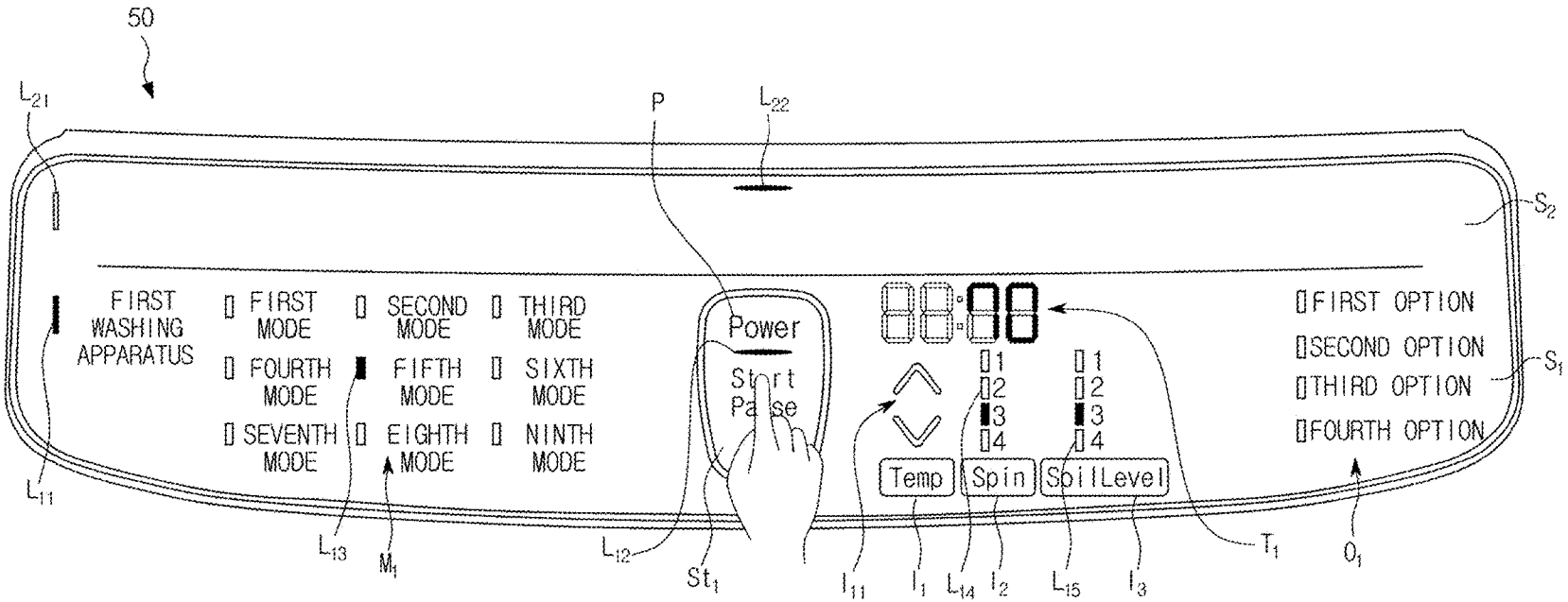
FIGS. 10A and 10B are views for describing a case in which a command to drive the second heater is input through the control panel while the first heater is in operation.
Figure 10B:
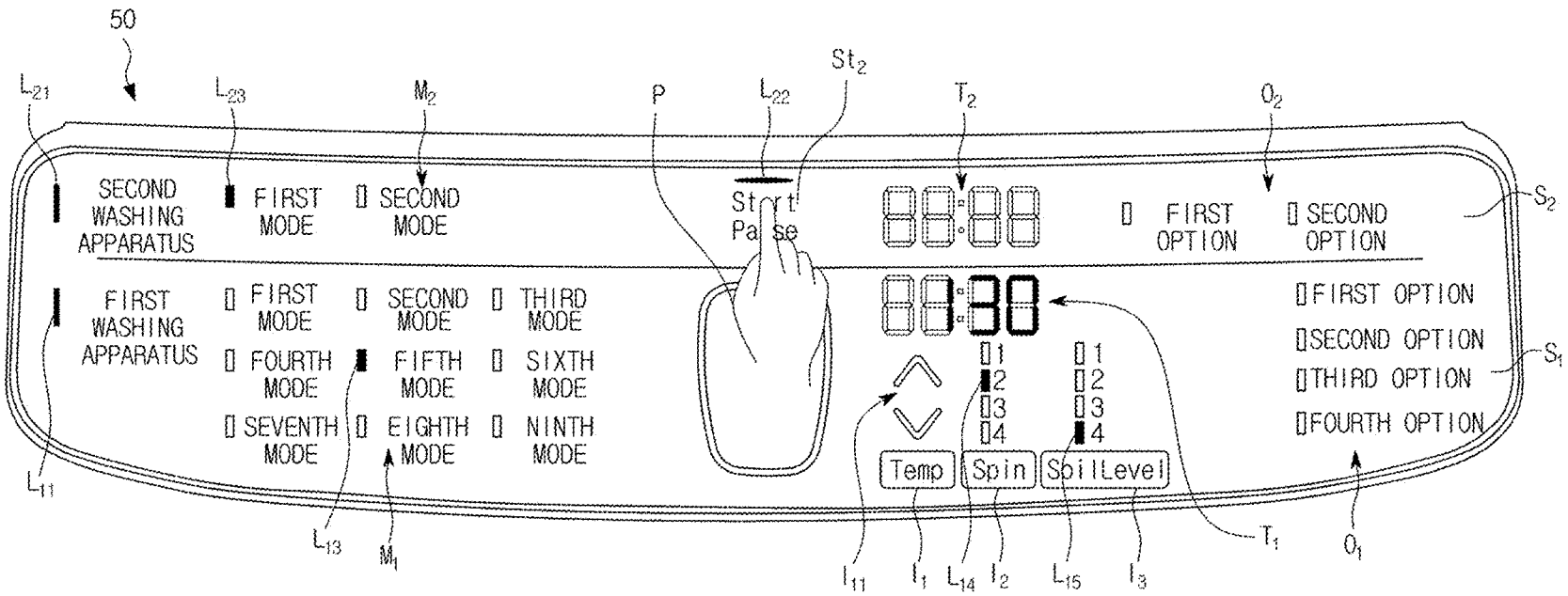

FIGS. 10A and 10B are views for describing a case in which a command to drive the second heater is input through the control panel while the first heater is in operation.

FIG. 10A is a view of a control panel in which the first section S1 is in an active state and the second section S2 is in an inactive state. Referring to FIG. 10A, it is confirmed that a fifth mode is selected for the first washing apparatus 10 and no option is selected. In this case, the user may input a target temperature setting command by touching the target temperature setting icon I11 on the control panel 50. As a result, the washing machine 1 may set a first target temperature for wash water stored in the first tub. The control panel 50 may display a set target temperature in the number information display region T1 of the control panel 50. FIG. 10A exemplarily illustrates a case where the first target temperature is set to 70° C.

When a wash start command for the first washing apparatus 10 is input by the user by touching the start icon SU of the control panel 50, the first washing apparatus 10 may perform washing in accordance with a set mode and a set first target temperature. In this regard, the controller 600 may drive the first heater 180 to heat wash water stored in the first tub to a first target temperature. Specifically, the controller 600 may supply a first driving current corresponding to the set first target temperature to the first main heater 181 and the first sub heater 182 of the first heater 180 and the first heater 180 may heat wash water by the supplied first driving current.

A touch on the second section S2 of the control panel 50 may be sensed while the first heater 180 is in operation and the second section S2 may be activated by the touch. FIG. 10B is a view of the control panel in which the second section S2 is in an active state. Referring to FIG. 10B, it may be confirmed that a first mode is selected for the second washing apparatus 20 by the user via the control panel 50 and no option is selected. It may also be confirmed that a second target temperature for wash water stored in the second tub 220 of the second washing apparatus 20 is set to 90° C.

Upon completion of the setting, the user may input a wash start command for the second washing apparatus 20 by touching the start icon St2 of the control panel 50. When the wash start command for the second washing apparatus 20 is input, the second washing apparatus 20 may perform washing in accordance with the set mode. As a result, the controller 600 may drive the second heater 290 to heat wash water stored in the second tub 220 to the second target temperature according to the first mode.

In this case, since the washing machine 1 is receiving the first driving current for driving the first heater 180, the controller 600 may control the second heater 290 such that the current supplied to the washing machine 1 does not exceed the reference current.

Figure 11:
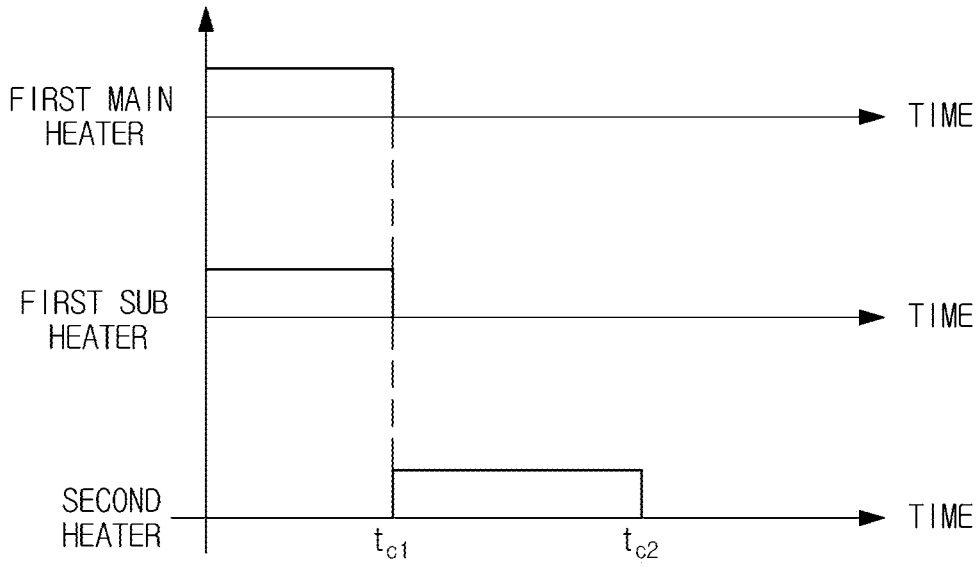
FIG. 11 is a graph exemplarily illustrating driving currents supplied to the heaters while a first heater is in operation according to an embodiment.

FIG. 11 is a graph exemplarily illustrating driving currents supplied to the heaters while a first heater is in operation according to an embodiment.

First, the first driving current may be supplied to the first heater 180. Specifically, a first main driving current may be supplied to the first main heater 181 and a first sub driving current may be supplied to the first sub heater 182. As a result, the first heater 180 may be driven by the first diving current.

Even when a wash start command for the second washing apparatus 20 including a command to drive the second heater 290 is input while the first heater 180 is in operation, the controller 600 may stop the operation of the second heater 290. For this purpose, the controller 600 may cut off a second driving current supplied to the second heater 290. On the contrary, the controller 600 may continuously drive the first heater 180.

As a result, a total amount of currents supplied to the washing machine 1 is a sum of the first main driving current and the first sub driving current which may be set to the predetermined reference current or less.

Referring to FIG. 11, wash water of the first tub 120 may be heated by driving the first main heater 181 to which the first main driving current is supplied and the first sub heater 182 to which the first sub driving current is supplied.

When a temperature of wash water of the first tub 120 reaches the first target temperature at a time point tc1, the controller 600 may stop the operation of the first main heater 181 and the first sub heater 182. Specifically, the controller 600 may stop the supply of the first main driving current to the first main heater 181 and stop the supply of the first sub driving current to the first sub heater 182.

Simultaneously or sequentially, the controller 600 may start driving of the second heater 290. That is, the controller 600 may drive the second heater 290 by resuming the supply of the second driving current, which has been cut off, to the second heater 290.

In this case, a total amount of currents supplied to the washing machine 1 is the same as the second driving current which may be set to be the predetermined reference current or less.

When the temperature of wash water of the second tub 220 reaches the second target temperature at a time point tc2 as a result of driving the second heater 290, the controller 600 may stop the operation of the second heater 290.

Alternatively, the controller 600 may also control the second heater 290 in any other method that the supplied current does not exceed the reference current.

Figure 12:
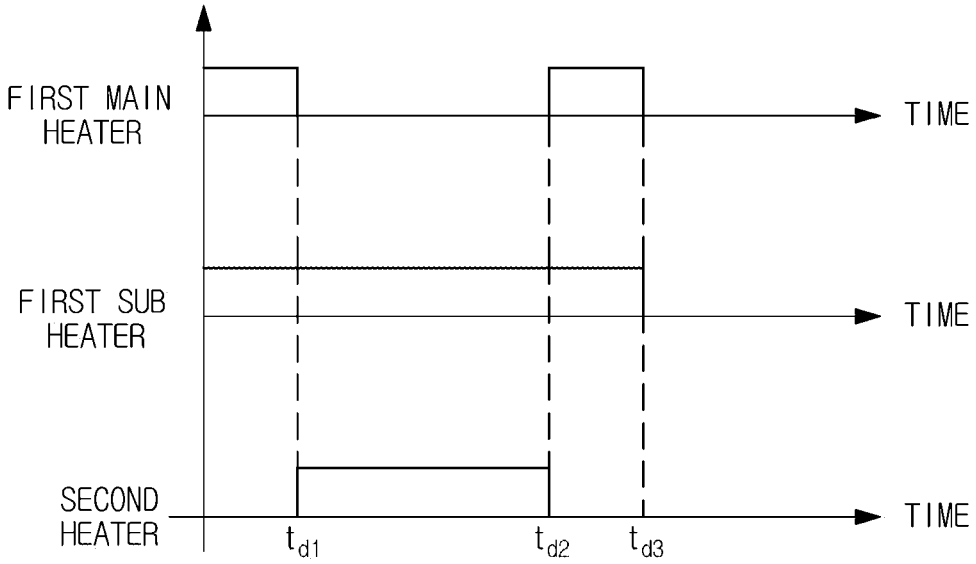
FIG. 12 is a graph exemplarily illustrating driving currents supplied to heaters while a first heater is in operation according to another embodiment.

FIG. 12 is a graph exemplarily illustrating driving currents supplied to heaters while a first heater is in operation according to another embodiment.

First, a first driving current may be supplied to the first heater 180. Specifically, a first main driving current may be supplied to the first main heater 181 and a first sub driving current may be supplied to the first sub heater 182. As a result, the first heater 180 may be in operation by the first driving current.

When a wash start command for the second washing apparatus 20 including a command to drive the second heater 290 is input while the first heater 180 is in operation, the controller 600 may stop the operation of the first main heater 181 of the first heater 180. Also, the controller 600 may start driving of the second heater 290.

As a result, a total amount of currents supplied to the washing machine 1 is a sum of the first sub driving current and a second driving current which may be set to the predetermined reference current or less.

Then, when a temperature of wash water stored in the second tub 220 reaches a second target temperature, the controller 600 may drive the first main heater 181 and the first sub heater 182 of the first heater 180 simultaneously with stopping the driving of the second heater 290.

Referring to FIG. 12, wash water of the first tub 120 may be heated by driving the first main heater 181 to which the first main driving current is supplied and the first sub heater 182 to which the first sub driving current is supplied.

When the wash start command including the command to start the second heater 290 is input at a time point td1, the controller 600 may stop the operation of the first main heater 181 and start driving of the second heater 290.

Then, when a temperature of wash water of the second tub 220 reaches the second target temperature at a time point td2, the controller 600 may stop the operation of the second heater 290 and resume the driving of the first main heater 181. Specifically, the controller 600 may stop the supply of the second driving current to the second heater 290 and resume the supply of the first main driving current to the first main heater 181.

In this case, a total amount of currents supplied to the washing machine 1 is a sum of the first main driving current and the first sub driving current which may be set to the predetermined reference current or less.

When the temperature of wash water of the first tub 120 reaches the first target temperature at a time point td3 as a result of driving the first heater 180, the controller 600 may stop the operation of the first heater 180.

The case where only the first heater includes the first main heater and the first sub heater has been described above. However, the second heater may also include a second main heater and a second sub heater.

Referring to FIG. 6B, the second heater may include a second main heater 290*a* operating with a second main power consumption and a second sub heater 290*b* operating with a second sub power consumption less than the second main power consumption.

In this case, when wash water stored in the first tub 120 and wash water stored in the second tub 220 are simultaneously heated, the controller 600 may simultaneously drive one of the first main heater 181 and the first sub heater 182 and one of the second main heater 290*a* and the second sub heater 290*b*. Particularly, the controller 600 may select one of the first main heater 181 and the first sub heater 182 and one of the second main heater 290*a* and the second sub heater 290*b* to prevent an overcurrent from flowing into the washing machine 1 in advance.

For example, the washing machine 1 may be set such that wash water stored in the first tub 120 is heated to a first target temperature and wash water stored in the second tub 220 is heated to a second target temperature. In this case, the controller 600 may select a heater to be driven by comparing the first target temperature with the second target temperature. Specifically, when the first target temperature is higher than the second target temperature, the controller 600 may simultaneously drive the first main heater 181 and the second sub heater 290*b*. As a result, a current less than the reference current may be stably supplied to the washing machine 1.

Since then, when a temperature of wash water stored in the second tub 220 reaches the second target temperature before a temperature of wash water stored in the first tub 120 reaches the first target temperature, the controller 600 may simultaneously drive the first main heater 181 and the first sub heater 182.

Alternatively, the controller 600 may also select a heater to be driven based on amounts of wash water respectively stored in the first tub 120 and the second tub 220. Specifically, when the amount of wash water stored in the first tub 120 is greater than that of wash water stored in the second tub 220, the controller 600 may simultaneously drive the first main heater 181 and the second sub heater 290*b*. In this case, a current less than the reference current may also be stably supplied to the washing machine 1.

Figure 13:
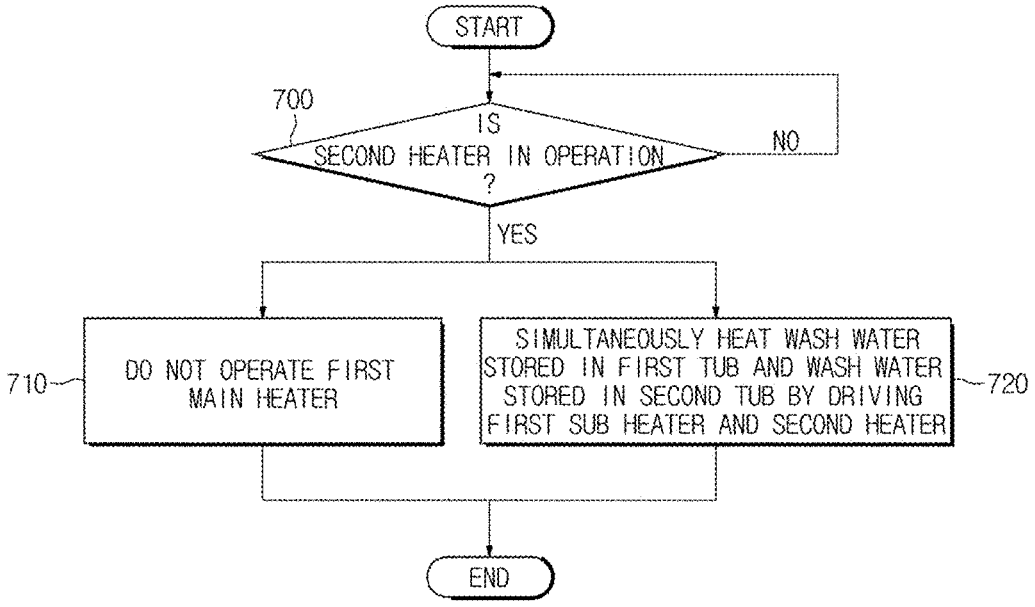
FIG. 13 is a flowchart for describing a method of controlling a washing machine according to an embodiment.

FIG. 13 is a flowchart for describing a method of controlling a washing machine according to an embodiment.

The washing machine 1 of FIG. 13 is based on the premise that wash water stored in the first tub 120 is heated by using at least one of the first main heater 181 and the first sub heater 182 operating with a power consumption lower than that required to drive the first main heater 181 and wash water stored in the second tub 220 is heated by using the second heater 290.

First, the washing machine 1 may determine whether or not the second heater 290 is in operation (700). In this case, the washing machine 1 may determine whether or not the second heater 290 is in operation by using various methods. For example, the washing machine 1 may determine an operation state of the second heater 290 by sensing a driving current supplied to the second heater 290 or by sensing a temperature of wash water stored in the second tub 220. Alternatively, the washing machine 1 may also determine the operation state of the second heater 290 by identifying whether a command to drive the second heater 290 is input.

When the second heater 290 is not in operation, the washing machine 1 may repeat this determination.

On the contrary, upon determination that the second heater 290 is in operation, the washing machine 1 may not drive the first main heater 181 (710). At the same time, the washing machine 1 may simultaneously heat wash water stored in the first tub 120 and wash water stored in the second tub 220 by driving the first sub heater 182 and the second heater 290 (720).

Thus, an inflow of an overcurrent into the washing machine 1 may be prevented in advance.

Figure 14:
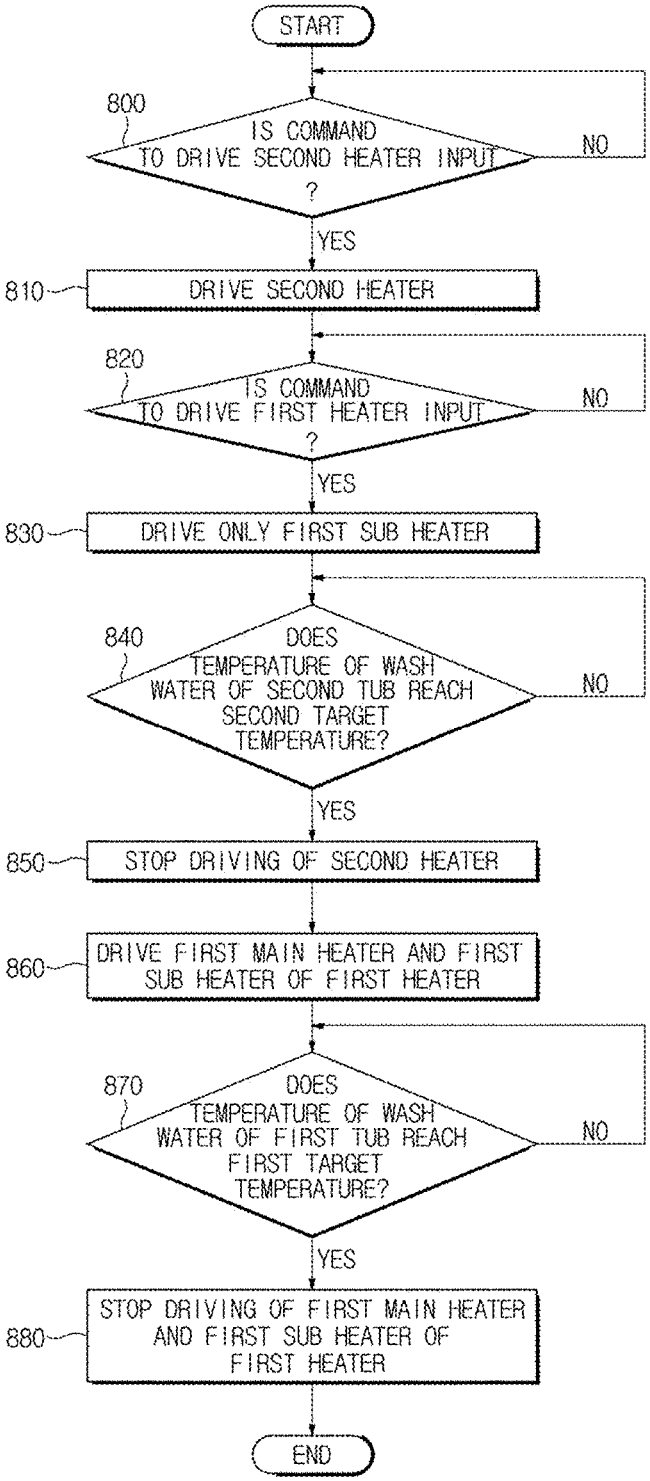
FIG. 14 is a flowchart for describing a method of controlling a washing machine according to another embodiment.

FIG. 14 is a flowchart for describing a method of controlling a washing machine according to another embodiment.

The washing machine 1 of FIG. 14 is based on the premise that wash water stored in the first tub 120 is heated by using one of the first main heater 181 and the first sub heater 182 operating with a power consumption lower than that required to drive the first main heater 181 and wash water stored in the second tub 220 is heated by using the second heater 290.

First, the washing machine 1 may determine whether or not a command to drive the second heater 290 is input (800). Specifically, the washing machine 1 may determine whether or not a wash start command including the command to drive the second heater 290 is input through the control panel 50. If the command to drive the second heater 290 is not input, the washing machine 1 may repeat this determination.

On the contrary, when the command to drive the second heater 290 is input, the washing machine 1 may drive the second heater 290 in accordance with the command to drive the second heater 290 (810). Specifically, the washing machine 1 may supply a second driving current to the second heater 290.

Then, the washing machine 1 may confirm whether a command to drive the first heater 180 is input (820). Specifically, the washing machine 1 may determine whether or not a wash start command including the command to drive the first heater 180 is input through the control panel 50. If the command to drive the first heater 180 is not input, the washing machine 1 may repeat this determination.

On the contrary, when the command to drive the first heater 180 is input, the washing machine 1 may drive only the first sub heater 182 of the first heater 180 (830). That is, the washing machine 1 may stop the driving of the first main heater 181 of the first heater 180.

In this case, a total amount of currents supplied to the washing machine 1 is a sum of the first sub driving current and the second driving current which may be set to the predetermined reference current or less.

Next, the washing machine 1 may determine whether or not a temperature of wash water of the second tub 220 reaches the second target temperature (840). If the temperature of wash water of the second tub 220 does not reach the second target temperature, the washing machine 1 may repeat this determination.

On the contrary, when the temperature of wash water of the second tub 220 reaches the second target temperature, the washing machine 1 may stop the driving of the second heater 290 (850). Specifically, the washing machine 1 may cut off the second driving current supplied to the second heater 290.

Then, the washing machine 1 may drive the first main heater 181 simultaneously with the first sub heater 182 of the first heater 180 (860). That is, the washing machine 1 may start driving of the first main heater 181 as well as the first sub heater 182 which is already in operation. To this end, the washing machine 1 may start the supply of the first main driving current to the first main heater 181.

In this case, a total amount of currents supplied to the washing machine 1 is a sum of the first main driving current and the first sub driving current which may be set to the predetermined reference current or less.

When the first main heater 181 and the first sub heater 182 are in operation, the washing machine 1 may determine whether a temperature of wash water of the first tub 120 reaches the first target temperature (870). If the temperature of wash water of the first tub 120 does not reach the first target temperature, the washing machine 1 may repeat this determination.

On the contrary, when the temperature of wash water of the first tub 120 reaches the first target temperature, the washing machine 1 may stop the operation of the first main heater 181 and the first sub heater 182 of the first heater 180 (880)

Figure 15:
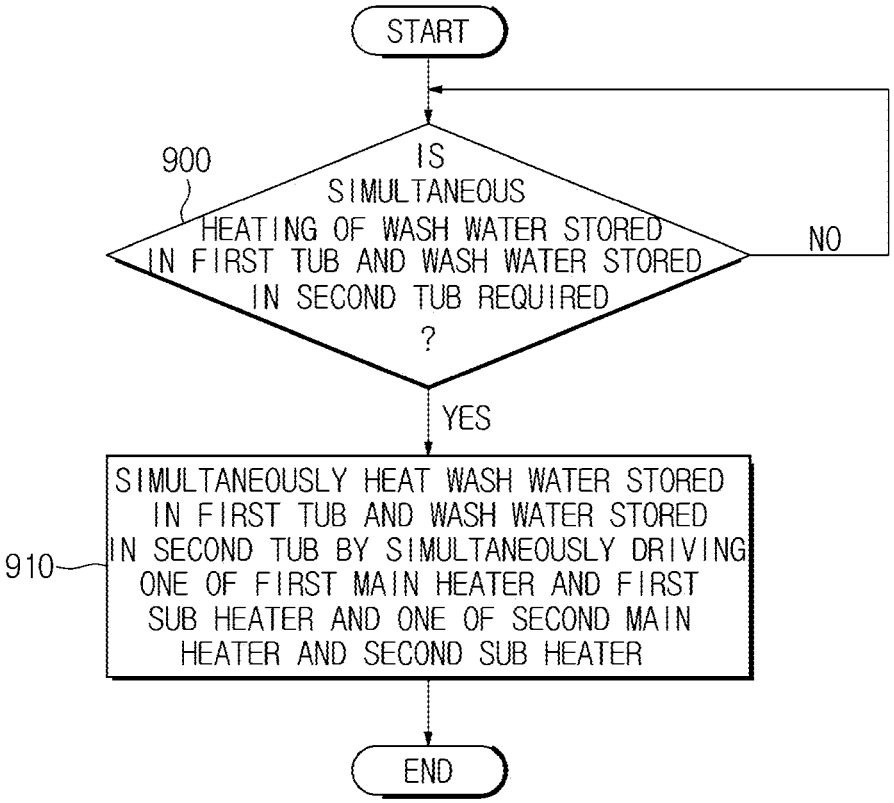
FIG. 15 is a flowchart for describing a method of controlling a washing machine according to another embodiment.

FIG. 15 is a flowchart for describing a method of controlling a washing machine according to another embodiment.

The washing machine 1 of FIG. 15 is based on the premise that wash water stored in the first tub 120 is heated by using one of the first main heater 181 and the first sub heater 182 operating with a power consumption lower than that required to drive the first main heater 181 and wash water stored in the second tub 220 is heated by using one of the second main heater 290*a* and the second sub heater 290*b* operating with a power consumption lower than that required to drive the second main heater 290*a*.

First, the washing machine 1 may determine whether or not wash water stored in the first tub 120 and wash water stored in the second tub 220 need to be heated simultaneously (900). In this case, the washing machine 1 may determine whether or not wash water of the first tub 120 and wash water of the second tub 220 need to be heated simultaneously by using various methods. For example, the washing machine 1 may determine whether or not wash water of the first tub 120 and wash water of the second tub 220 need to be heated simultaneously by identifying whether or not a command to drive the first heater 180 and a command to drive the second heater 290 are input.

Upon determination that wash water of the first tub 120 and wash water of the second tub 220 do not need to be heated simultaneously, the washing machine 1 may repeat this determination.

On the contrary, upon determination that wash water of the first tub 120 and wash water of the second tub 220 need to be heated simultaneously, the washing machine 1 may simultaneously drive one of the first main heater 181 and the first sub heater 182 and one of the second main heater 290*a* and the second sub heater 290*b* (910).

For example, when the first target temperature of wash water stored in the first tub 120 is higher than the second target temperature of wash water stored in the second tub 220, the washing machine 1 may drive only the first main heater 181 and the second sub heater 290*b* simultaneously without driving the first sub heater 182 and the second main heater 290*a*.

Thus, an inflow of an overcurrent into the washing machine 1 may be prevented in advance.

As is apparent from the above description, according to the washing machine and the method of controlling the same, an inflow of an overcurrent into the washing machine may be prevented by stopping the operation of the first main heater of the first heater that heats wash water stored in the first tub while the second heater that heats wash water stored in the second tub is in operation. Thus, the washing machine may have excellent durability and consumer safety.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A method of controlling a clothes treating machine comprising a first main heater configured to supply heat to a first tub; a first sub heater configured to supply heat to the first tub and operating with a power consumption lower than power consumption required to drive the first main heater; and a second heater configured to supply heat to a second tub, the method comprising:

determining whether the second heater is in operation; and as a result of the determination that the second heater is in operation, stopping driving of the first main heater.

2. The method of claim 1, further comprising simultaneously driving the first sub heater and the second heater upon determination that the second heater is in operation.

3. The method of claim 2, wherein the simultaneously driving of the first sub heater and the second heater is performed by simultaneously driving the first sub heater and the second heater to increase a temperature of wash water stored in the first tub and wash water stored in the second tub to a predetermined first target temperature and a predetermined second target temperature respectively.

4. The method of claim 3, further comprising simultaneously driving the first main heater and the first sub heater when the temperature of wash water stored in the second tub reaches the second target temperature before the temperature of wash water stored in the first tub reaches the first target temperature.

5. The method of claim 3, further comprising stopping heating of wash water stored in the second tub when the temperature of wash water stored in the second tub reaches the second target temperature before the temperature of wash water stored in the first tub reaches the first target temperature.

6. The method of claim 1, wherein the second heater comprises a second main heater configured to supply heat to the second tub; and a second sub heater configured to supply heat to the second tub and operating with a power consumption lower than a power consumption required to drive the second main heater, and wherein the method further comprises:

determining whether the first tub and the second tub need to be supplied with heat simultaneously; and simultaneously heating one of the first main heater and the first sub heater and one of the second main heater and the second sub heater upon determination that the first tub and the second tub need to be supplied with heat simultaneously.

7. The method of claim 6, wherein the simultaneously heating of one of the first main heater and the first sub heater and one of the second main heater and the second sub heater is performed by simultaneously heating one of the first main heater and the first sub heater and one of the second main heater and the second sub heater to increase a temperature of wash water stored in the first tub and wash water stored in the second tub to a predetermined first target temperature and a predetermined second target temperature respectively.

8. The method of claim 7, wherein the simultaneously heating of one of the first main heater and the first sub heater and one of the second main heater and the second sub heater is performed by simultaneously driving the first main heater and the second sub heater when the first target temperature is higher than the second target temperature.

9. The method of claim 7, further comprising simultaneously driving the first main heater and the first sub heater when the temperature of wash water stored in the second tub reaches the second target temperature before the temperature of wash water stored in the first tub reaches the first target temperature.

10. The method of claim 6, wherein the simultaneously heating of one of the first main heater and the first sub heater and one of the second main heater and the second sub heater is performed by simultaneously driving the first main heater and the second sub heater when an amount of wash water stored in the first tub is greater than an amount of wash water stored in the second tub while wash water stored in the first tub and wash water stored in the second tub are simultaneously heated.

11. A method of controlling a clothes treating machine comprising a first main heater configured to supply heat to a first tub; a first sub heater configured to supply heat to the first tub and operating with a power consumption lower than power consumption required to drive the first main heater; and a second heater configured to supply heat to a second tub, the method comprising:

determining whether both the first sub heater and the second heater are in operation; and as a result of the determination that both the first sub heater and the second sub heater are in operation, controlling the first main heater not to operate.

* * * * *